US005628128A

United States Patent [19]

Miller et al.

[11] Patent Number: 5,628,128

[45] Date of Patent: *May 13, 1997

[54] SOLE CONSTRUCTION FOR FOOTWEAR

[75] Inventors: Todd Miller, West Linn; David Gasparovic, Beaverton, both of Oreg.; Craig Feller, Duxbury, Mass.; Daniel Wickemeyer; David Potter, both of Venice, Calif.; Erik Purdom, Battle Ground, Wash.; Tuan Le, Portland, Oreg.

[73] Assignee: American Sporting Goods Corp., Irvine, Calif.

[ * ] Notice: The portion of the term of this patent subsequent to Nov. 1, 2014, has been disclaimed.

[21] Appl. No.: 484,388

[22] Filed: Jun. 7, 1995

Related U.S. Application Data

[63] Continuation-in-part of Ser. No. 332,041, Nov. 1, 1994.

[51] Int. Cl.[6] ..... A43B 3/18; A43B 21/26

[52] U.S. Cl. ..... 36/28; 36/35 R; 36/114

[58] Field of Search ..... 36/103, 114, 25 R, 36/27, 28, 34 R, 35 R, 36 R, 142, 143, 144, 128

[56] References Cited

U.S. PATENT DOCUMENTS

| | | |
|---|---|---|
| Re. 33,066 | 9/1989 | Stubblefield . |
| 1,535,207 | 4/1925 | Dorff . |
| 4,259,792 | 4/1981 | Halberstadt . |
| 4,271,606 | 6/1981 | Rudy . |
| 4,305,212 | 12/1981 | Coomer . |
| 4,335,530 | 6/1982 | Stubblefield . |
| 4,372,058 | 2/1983 | Stubblefield . |
| 4,439,936 | 4/1984 | Clarke et al. . |
| 4,449,307 | 5/1984 | Stubblefield . |
| 4,481,727 | 11/1984 | Stubblefield . |
| 4,536,974 | 8/1985 | Cohen . |
| 4,546,556 | 10/1985 | Stubblefield . |
| 4,550,510 | 11/1985 | Stubblefield . |
| 4,611,412 | 9/1986 | Cohen . |
| 4,694,591 | 9/1987 | Banich et al. . |
| 4,741,114 | 5/1988 | Stubblefield . |
| 4,753,021 | 6/1988 | Cohen . |
| 4,754,559 | 7/1988 | Cohen . |
| 4,785,557 | 11/1988 | Kelley et al. . |
| 4,817,304 | 4/1989 | Parker et al. . |
| 5,005,299 | 4/1991 | Whatley . |
| 5,005,300 | 4/1991 | Diaz et al. . |
| 5,014,449 | 5/1991 | Richard et al. . |
| 5,079,856 | 1/1992 | Truelsen . |
| 5,172,494 | 12/1992 | Davidson . |
| 5,282,288 | 2/1994 | Henson . |

FOREIGN PATENT DOCUMENTS

| | | |
|---|---|---|
| WO8905105 | 6/1989 | Denmark . |
| WO9208384 | 5/1992 | Germany . |

OTHER PUBLICATIONS

Adidas Recoil–X technology flyer advertisement, date unknown.

"On the Drawing Board", *Sporting Goods Business,* Jul. 1994, pp. 64–66 and 68.

Brooks advertisement, *Sporting Goods Business,* Jul. 1994, pp. 30–31.

*Primary Examiner*—Ted Kavanaugh

*Attorney, Agent, or Firm*—Michael A. Painter

[57] ABSTRACT

The footwear sole construction has a sole element disposed in the heel region of the sole. The sole element includes a first pod disposed on the medial side of the sole and a second pod disposed on the lateral side of the sole. The first pod is connected to the second pod by a web. A lower side of the sole element defines a concavity such that a lower surface of the first and second pods are disposed for contacting a ground surface. The first and second pods each include cavities extending therethrough such that a first open end of a cavity is disposed on one of the medial and lateral sides of the pod and a second open end of that cavity is disposed on the lower surface of such pod. The placement of the cavities and the orientation of the pods allow for tailoring and control of shock absorption.

18 Claims, 41 Drawing Sheets

SOLE CONSTRUCTION FOR FOOTWEAR

REFERENCE TO RELATED APPLICATIONS

This application is a continuation-in-part of application Ser. No. 08/332,041, filed Nov. 1, 1994 and is now pending.

BACKGROUND OF THE INVENTION

1. Field of the Invention

This invention relates to footwear construction. More particularly, this invention relates to the configuration of lugs of an outsole for footwear to provide improved cushioning and stability characteristics.

2. Description of Related Art

Due to an increase in the popularity of exercise, as well as everyday walking and standing, there is a need to alleviate and relieve stress on a person's feet and legs. It is important that shoes and other footwear, such as sandals, provide adequate shock absorption and stability. Moreover, it is important to have a shoe construction that accommodates the gait cycle of the individual wearer for the particular activity being engaged in.

Typically, it is the midsole of the shoe that provides the cushioning and stability to the foot of a wearer. In a conventional shoe, either polyurethane foam, EVA (ethyl vinyl acetate) foam or perhaps HYTREL foam is used as the material which provides most of the cushioning of the shoe (HYTREL is a trademark of DuPont du Numeurs & Co.). Other materials used for cushioning in the midsole include fluid filled bags.

In contrast, the outsole of a shoe and, in particular, the outsole of an athletic shoe is viewed as a necessary liability with respect to cushioning. Typically, the function of the outsole is to provide an abrasive resistant material for contacting the ground. This material, typically rubber, is heavy and provides minimal cushioning.

In the late 1970's, a shoe was developed which, for the first time, utilized the outsole of an athletic shoe to provide significant cushioning and stability to the foot of a wearer. This shoe, described in U.S. Pat. No. 4,372,058 to Stubblefield, features an outsole for a shoe designed to reduce stress on a person's feet and legs. The outsole is provided with outwardly disposed flexible lugs inclined at an obtuse angle to the lower surface of the shoe sole. This angular configuration allows the lugs to spread outwardly upon impact with the ground and thereby dissipate impact forces away from the foot and leg of the wearer. Although this shoe provides shock absorption, the need for improved shock absorption is incessant in the footwear industry.

Accordingly, one object of the invention is to provide an athletic shoe having improved shock absorption and stability.

Another object of the invention is to have the ability to vary the characteristics of the shoe sole so that the shoe can accommodate different types of use, as well as different amounts of support in different areas of a single shoe.

Another object of the invention is to provide a sole that is recyclable.

Another object of the invention is to provide means by which a strap can be used to help support the arch of the wearer or the entire foot.

SUMMARY OF THE INVENTION

The foregoing objects are attained by the present invention, which pertains to footwear construction. The footwear may include any type of sole for being disposed on a wearer. The footwear construction may include a midsole formed from a shock absorbing material. The midsole has a medial side and a lateral side. A first pod is disposed on the lateral side of the midsole. At least one cavity extends through the first pod. A second pod is disposed on the medial side of the midsole. At least one cavity extends through the second pod. The pods may have a lower surface for contacting a contact surface that is substantially abrasive resistant. The first pod and the second pod are oriented to provide shock absorption upon contact with a contact surface.

Another embodiment of the invention includes a sole element for a shoe. The sole element includes a first pod for being disposed on a lateral side of the shoe and a second pod for being disposed on a medial side of the shoe. A web extends between the first and second pods. The first and second pods each have a lower surface for contacting a contact surface and lower surface of each pod is substantially abrasive resistant. The first pod, second pod and web are disposed on the shoe such that the first and second pods provide shock absorption and stability upon contact with the contact surface. The first and second pods each include a cavity and, more preferably, a plurality of cavities. The lower surface of the first pod, the lower side of the web and the lower surface of the second pod define a substantially concave surface and thereby a concavity under the shoe. The sole element may be exposed on the midsole of the shoe or footwear.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings, which form a part of the original disclosure.

DETAILED DESCRIPTION OF PREFERRED EMBODIMENTS

Figure 1:
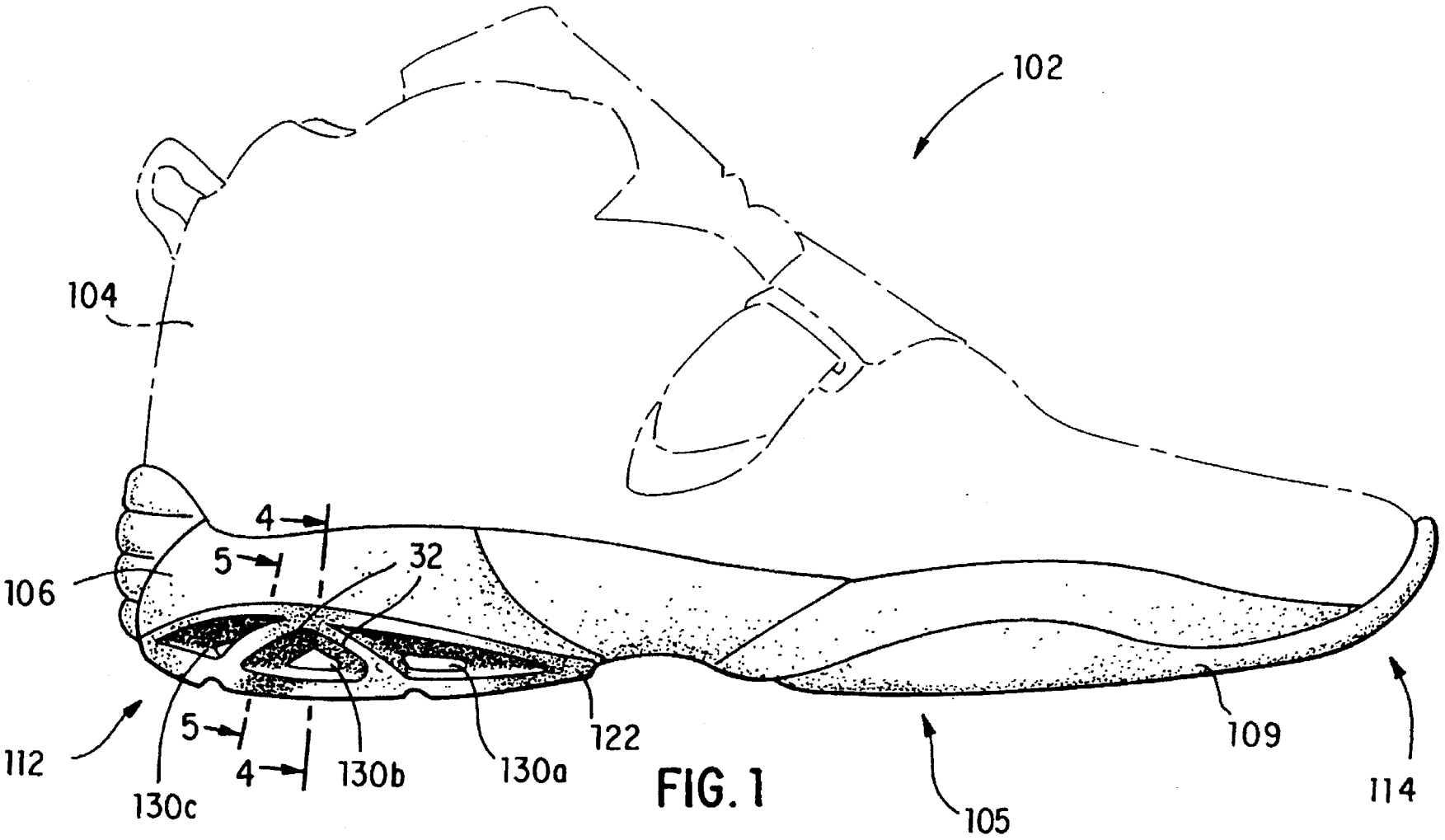
FIG. 1 is a side view of a footwear construction in accordance with a first embodiment of the invention.
Figure 2:
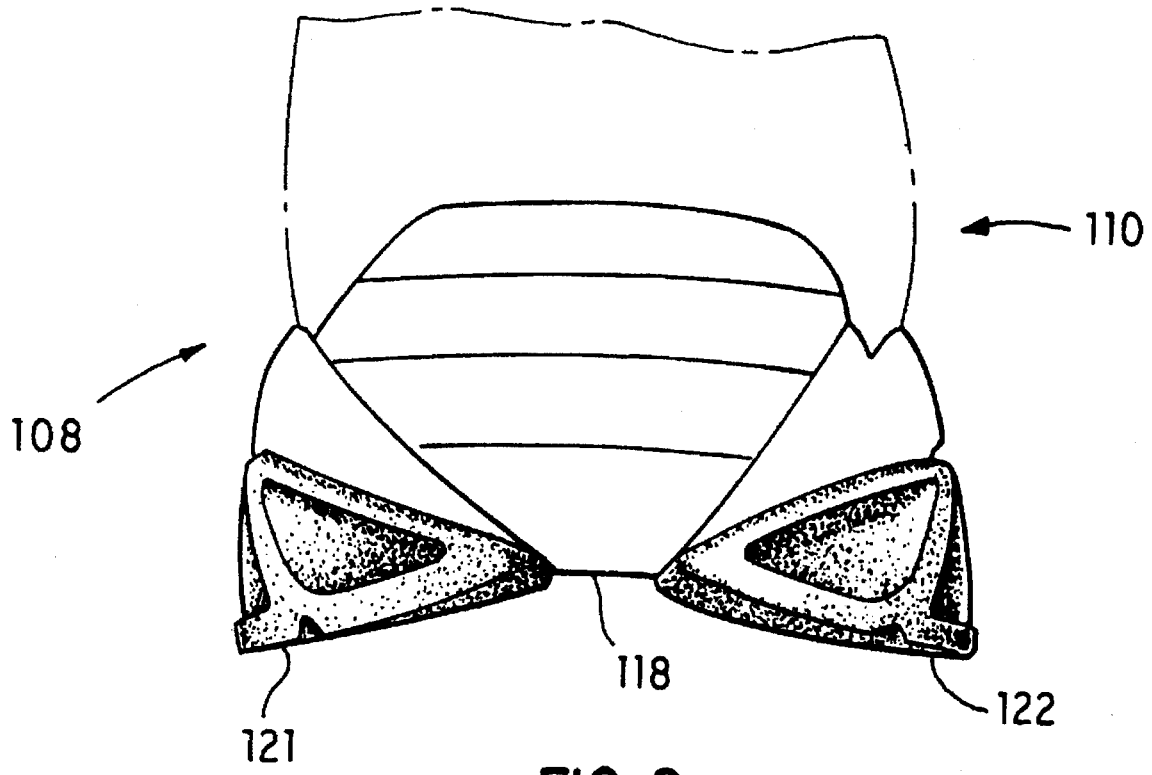
FIG. 2 is a rear view in accordance with the first embodiment of the invention.
Figure 3:
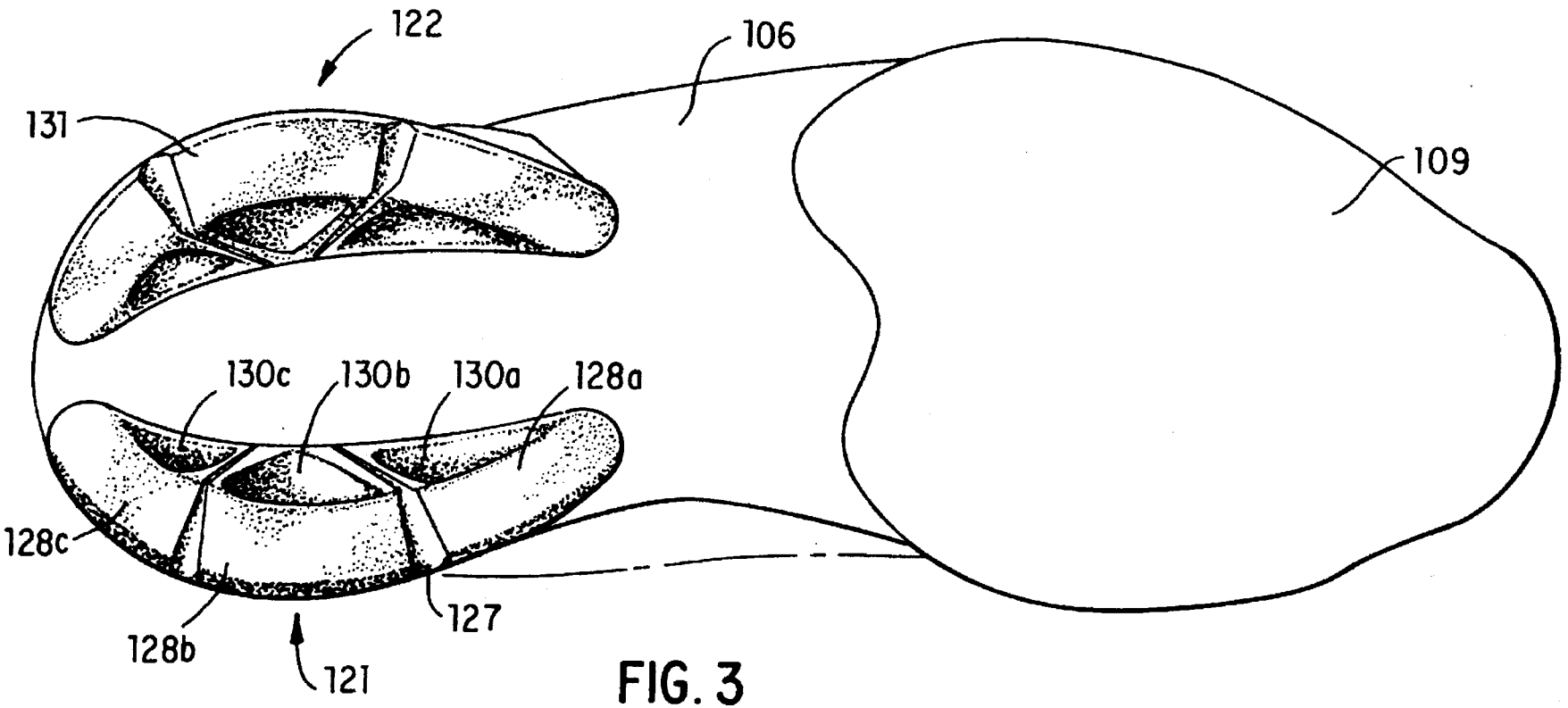
FIG. 3 is a bottom view in accordance with the first embodiment of the invention.

Referring now to the drawings, wherein like reference numbers represent identical or corresponding parts throughout the several views, FIGS. 1–3 show a first embodiment in accordance with the invention. FIG. 1 illustrates a medial side of a shoe for use on a right foot of a wearer. A left shoe incorporating the present invention would be a mirror image of that shown in FIG. 1. In FIGS. 1–3, a shoe 102 is shown having an upper 104 and a sole 105. Shoe 102 includes a medial side 108, a lateral side 110, a heel region 112 and a forefoot region 114. The upper 104 used in conjunction with the present invention may be any conventional shoe upper, including an upper as might be found in an athletic shoe. Although the description of the invention is directed toward an athletic shoe, such as a shoe used for running, basketball, aerobics and the like, it should be understood that the invention may be incorporated into street shoes, boots (such as hiking boots) or even into shoes which do not have an upper per se, such as a sandal. Upper 104 may be attached to sole 105 in any conventional manner. However, upper 104 need not be limited to a conventional upper 104, and may comprise, for example, an extension of sole 105 that wraps around a toe or ankle, a strap to tie sole 105 to the foot of a wearer or even adhesive to adhesively attach sole 105 to the foot of a wearer.

Figure 4:
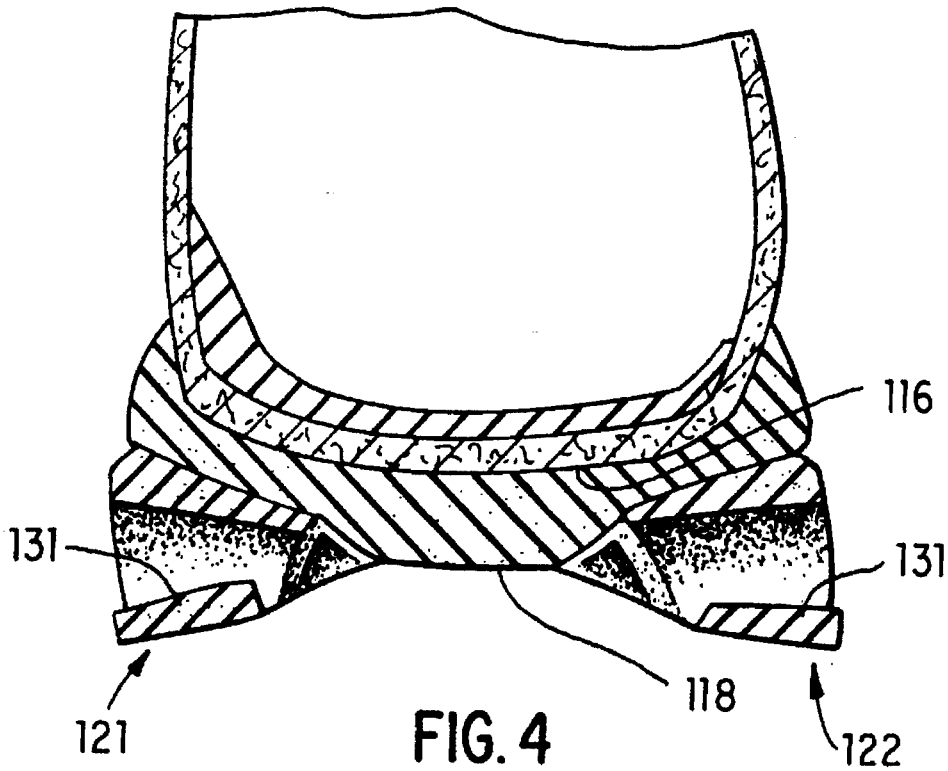
FIG. 4 is a cross-sectional view taken along line 4—4 shown in FIG. 1.
Figure 5:
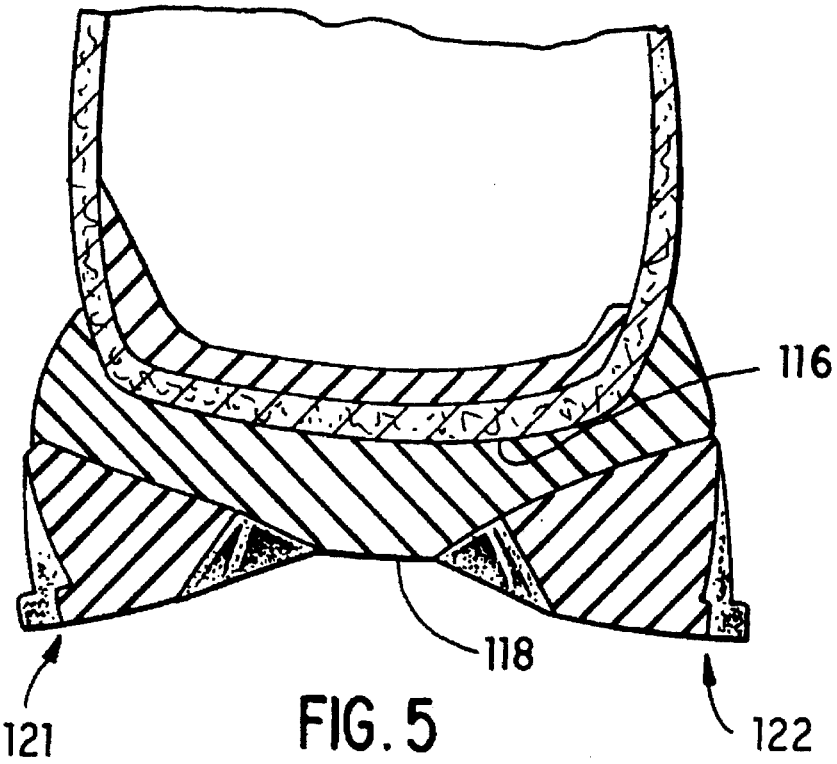
FIG. 5 is a cross-sectional view taken along line 5—5 shown in FIG. 1.
Figure 6:
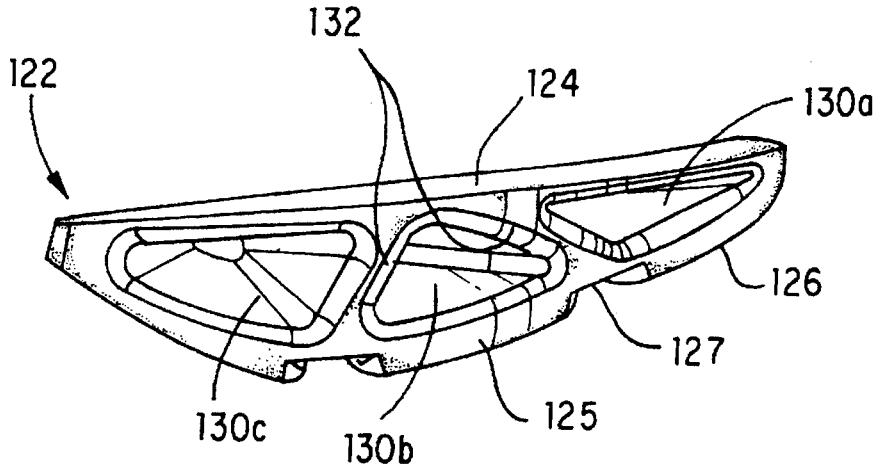
FIG. 6 is a perspective view of a footwear sole pod in accordance with the first embodiment of the invention.
Figure 7:
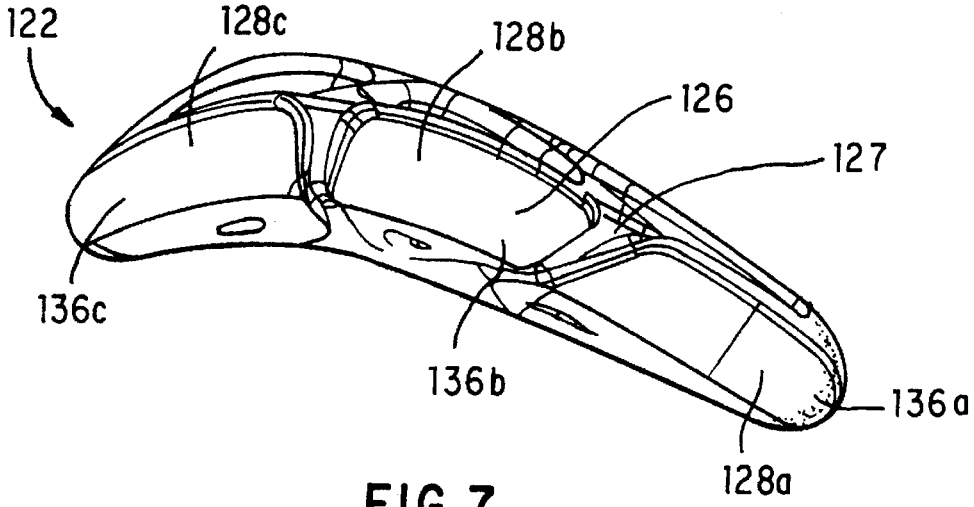
FIG. 7 is a perspective view of the bottom of the pod in accordance with the first embodiment of the invention.
Figure 8:
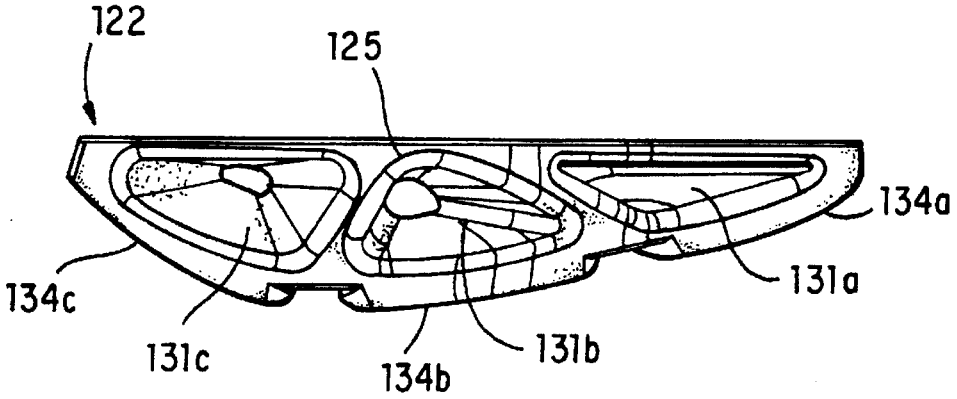
FIG. 8 is a side view of the pod in accordance with the first embodiment of the invention.
Figure 9:
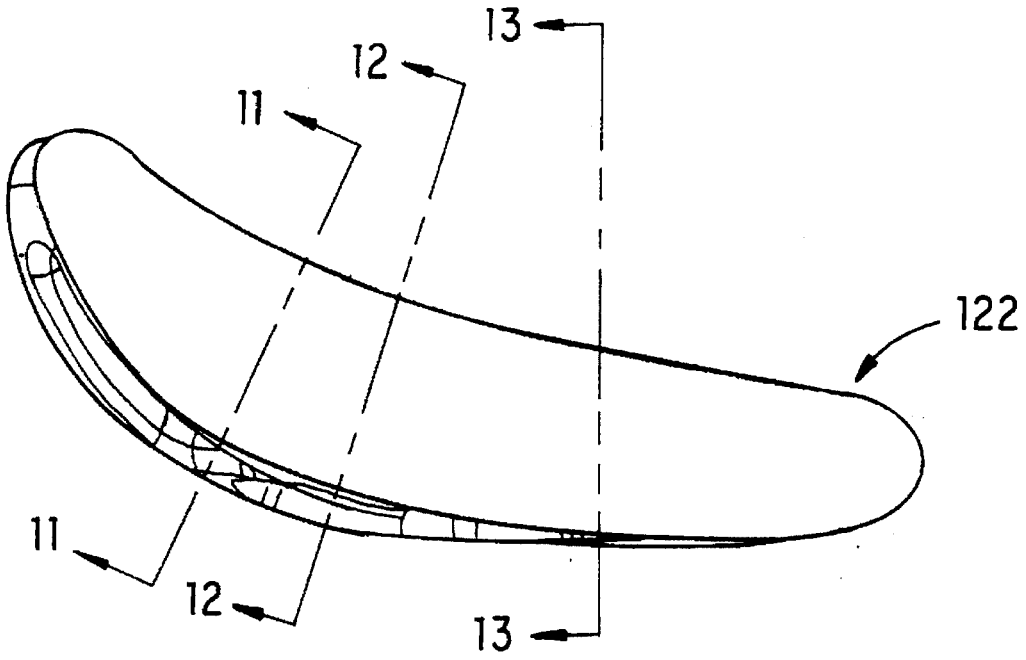
FIG. 9 is a top view of the pod in accordance with the first embodiment of the invention.

Sole 105 need not be limited to conventional sole components. Sole 105 may be formed of several components including a midsole 106 and a forefoot pad 109. However, the shock absorption element in accordance with the invention may comprise the entire sole 105. Sole 105 may, but does not need to, include any conventional sole 105 constituents. Midsole 106 can be made from any conventional cushioning material such as polyurethane (PU) or ethyl vinyl acetate (EVA). Midsole 106 may be eliminated or may be designed to extend in any portion of sole 105, such as a forefoot region 114 or a heel region 112. Midsole 106 includes an upper surface 116 (FIG. 4) and a lower surface 118.

In accordance with a first embodiment of the invention, pods 121 and 122 are provided. A purpose of pods 121 and 122 and cavities 130*a*, 130*b* and 130*c* is to provide cushioning and stability to the foot of the wearer upon loading or heel strike and a return of useable energy upon shifting of loading from the heel to forefoot. In particular, upon heel strike (usually, on lateral side 110 of heel region 112), pod 121 makes contact with the ground. Upon contact, pod 121 deflects outwardly from a vertical center of the calcaneus thereby providing cushioning and stability to the foot of a wearer.

Pods 121 and 122 define either a single cavity or a plurality of cavities 130*a*, 130*b* and 130*c*. These cavities 130*a*, 130*b* and 130*c* reduce the weight of pods 121 and 122 while improving the cushioning and stability characteristics of pods 121 and 122. Cavities 130*a*, 130*b* and 130*c* segment sole 105 so that parts of sole 105 can be compressed without distortion of adjacent areas. Accordingly, parts of sole 105 may return to their original state independent of the adjacent areas. For example, struts 132 defined by cavities 130*a*, 130*b* and 130*c*, may articulate independently.

During a normal running gait cycle, the foot of a wearer will roll from heel strike (or lateral side 110 of shoe 102) to a midfoot stance wherein medial pod 122 makes contact with the ground. Thus, lateral side 110 is impacted with greater force initially than medial side 108. Because medial pod 121 and lateral pod 122 do not necessarily experience the same downward application of force, the characteristics of medial pod 121 and lateral pod 122 may differ. For example, one of the pods may be formed of a material having a greater hardness than the other. The rigidity of pods 121 and 122 can be varied by varying the placement and quantity of cavities 130*a*, 130*b*, 130*c* and struts 132.

In addition, during a normal running gait cycle, the foot rolls from heel strike to toe off at a speed or rate. The speed of the natural roll of a bare foot is slower than the speed when any type of shoe is placed on the foot. This is because the shoe acts as a lever increasing the speed of roll of the foot. In accordance with the invention, such speed may be controlled and regulated, for example, by varying the placement, positioning, material, hardness, quantity or size of pods 121 and 122, and/or cavities 130*a*, 130*b* and 130*c*.

It is also within the scope of the invention to have inserts that are permanently or temporarily insertable into any one or more of cavities 130*a*, 130*b* and/or 130*c*, as will be discussed in greater detail in the following discussion regarding a second embodiment of the invention. For example, inserts in pods 121 and 122 may assist in tailoring rear foot stability. Accordingly, a shoe may be tailored to accommodate different uses by a single user or to accommodate and custom fit different users. For example, the inserts may be, for example, rigid, resilient, solid or hollow so as to adjust the stability and cushioning provided by the shoe. In addition, the inserts may be decorative. For example, the inserts may comprise various colors to color coordinate shoes with clothing. In summary, the inserts would provide for interactive adjustment for the consumer and custom tuning of the firmness of the shoe and sole. It is within the scope of the invention to provide any embodiments of the invention with individualized stability and support.

Struts 132 may be disposed and selectively positioned between cavities 130*a*, 130*b* and 130*c*. A base portion of struts 132 connect with a traction hoop 131, which extends along a bottom of pods 121 and 122. Traction hoop 131, as well as, entire pods 121 and 122, may be generally crescent shaped and define a radius. Upon loading, struts 132 spread outwardly and traction hoop 131 spreads annularly increasing the radius of the crescent defined by traction hoop 131. Struts 132 serve as articulating members and their placement and position allow the degree of cushioning and stability to be tailored for different needs. Traction hoop 131 offers a return of energy upon shifting of body weight from the heel to forefoot. However, it is within the scope of the invention to modify traction hoop 131 and how it connects with struts 132. In addition, traction hoop 131 may be eliminated.

In accordance with the first embodiment, struts 132 form a V-shape. However, the placement and angle of the struts 132 can be varied based on the desired amount of shock absorption, stability and expansion of pods 121 and 122 upon impact. In addition, as shown in the figures, struts 132 may extend along an entire length between cavities 130*a*, 130*b* and 130*c*. However, struts 132 may be discontinuous, include openings, vary in thickness, vary in rigidity, vary in angle of orientation or vary in frequency. In addition, additional struts 132 may be disposed inside cavities 130*a*, 130*b* and 130*c* and, for example, extend along a length, width or diagonal of cavities 130*a*, 130*b* and 130*c*. In accordance with the invention, the use of the term struts 132 is not intended to be limited to any particular conventional construction and may include whatever separates one cavity from another cavity.

Pods 121 and 122 in accordance with a first embodiment of the invention are disposed on heel region 112 of midsole 106. If midsole 106 is not included in sole 105, pods 121 and 122 can be formed to be disposed on upper 104 or any other type of shoe member. In the alternative, pods 121 and 122 may alone comprise the entire sole 105. As well, pods 121 and 122 may be disposed in or on any portion of sole 105. This embodiment of the present invention is directed toward the orientation and structure of pods 121 and 122. Pod 121 is located on the periphery of medial side 108 of heel region 112 and pod 122 is located on the periphery of lateral side 110 of heel region 112. It is, however, anticipated that the location and placement of pods 121 and 122 on midsole 106, sole 105, or otherwise can be varied. Pods 121 and 122 can be constructed of varying length, width and angle of curvature to accommodate various sized shoes, various intended uses and various types of users. For example, pods 121 and 122 can also be disposed on forefoot region 114, along the entire lateral and medial sides 108 and 110 or around the entire periphery of the midsole 106. Generally, the height of pods 121 and 122, if used in forefoot region 114 of a shoe, would be less than the height as used in heel region 112.

Pods 121 and 122 in accordance with the first embodiment of the invention are made of an abrasive resistant material with a Shore A hardness in the range of 60–80. In particular, in the embodiment shown, it is important that a lowermost surface of pods 121 and 122 be made of an abrasive resistant material. Accordingly, as will be explained in more detail later, pods 121 and 122 may be formed of either an abrasive resistant material or alternatively, may be made primarily of a foam material with a thin outsole material covering the lowermost surfaces of pods 121 and 122 which are likely to make contact with the ground. For example, pods 121 and 122 can be made of an outsole elastomeric material such as MILLATHANE. Of course, if pods 121 and 122 are embedded in sole 105 and are not going to be exposed to a contact surface, the materials from which pods 121 and 122 are made can be varied accordingly.

In the embodiment of the invention shown in FIGS. 1–3, forefoot pad 109 and pods 121 and 122 are used, and in combination may be considered to comprise an outsole of shoe 102.

Now referring to FIGS. 6–10, pods 121 and 122 in accordance with the first embodiment of the invention are discussed in greater detail.

Pods 121 and 122 include an upper surface 124, a lower surface 126 and a side surface 125. Cavities 130*a*, 130*b* and 130*c* may extend completely through pods 121 and 122 (as shown in FIGS. 6–13). Each of cavities 130*a*, 130*b* and 130*c* have open ends 131*a*, 131*b* and 131*c* (FIG. 8) on side surface 125. As shown in this embodiment, cavities 130*a*, 130*b* and 130*c* may have open ends 133*a*, 133*b* and 133*c* (FIG. 10) on respective sloping surfaces 138*a*, 138*b* and 138*c*. Cavities 130*a*, 130*b* and 130*c* may, however, open onto any of the surfaces of pods 121 and 122. In addition, in an alternate embodiment, any of cavities 130*a*, 130*b* and 130*c* may extend only partially through the pods 121 and 122. For example, one or more of open ends 131*a*, 131*b*, 131*c*, 133*a*, 133*b* and 133*c* may be closed. As discussed in greater detail in the following discussion, inserts may be provided for being disposed in cavities 130*a*, 130*b* and 130*c* to tailor pods for individualized or varying uses.

In addition, cavities 130*a*, 130*b* and 130*c* may include various configurations, for example, they may expand in size from open ends 133*a*, 133*b* and 133*c* toward open ends 131*a*, 131*b* and 131*c*. Cavities 130*a*, 130*b* and 130*c* may be a constant size; decrease or increase in size toward side surface 125; or vary in size between side surface 125 and the respective sloping surfaces 138*a*, 138*b* and 138*c*. Furthermore, although the embodiment shown has generally linearly directed cavities 130*a*, 130*b* and 130*c*, cavities 130*a*, 130*b* and 130*c* may curve, twist or wind in any desired directions. Varying the configuration of cavities 130*a*, 130*b* and 130*c* also allows for the placement of open ends 131*a*, 131*b*, 131*c*, 133*a*, 133*b* and 133*c* to be varied. Variations in the configurations, as well as the quantity, of cavities 130*a*, 130*b* and 130*c* allow pods 121 and 122 to be tailored to achieve the desired amount of shock absorption and stability.

Figure 10:
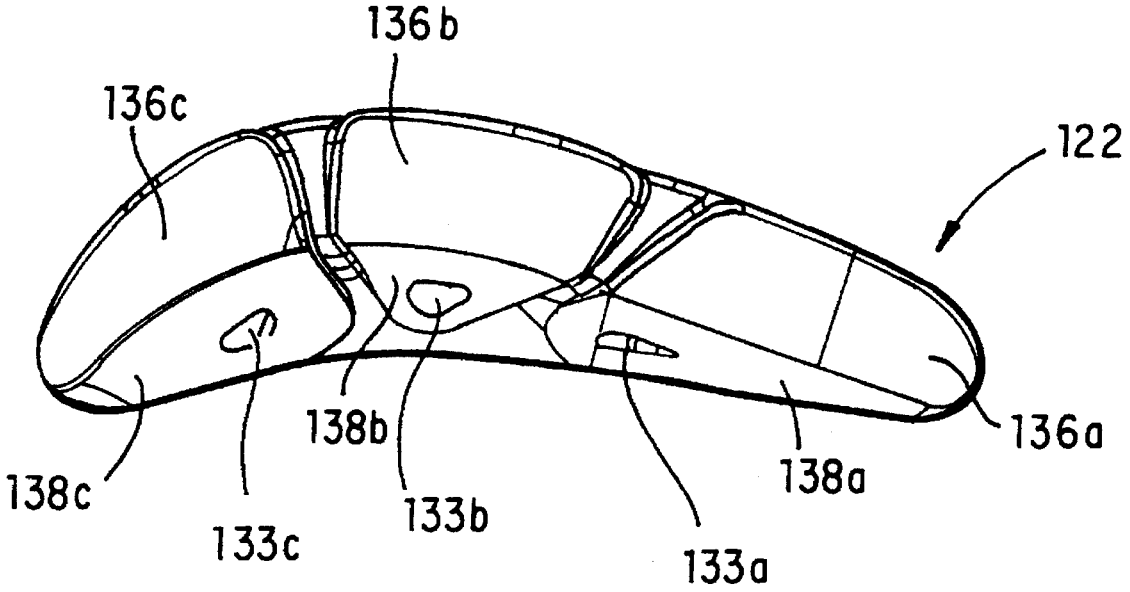
FIG. 10 is a bottom view of the pod in accordance with the first embodiment of the invention.

As shown in FIG. 10, for example, the relationship between outermost surfaces 136*a*, 136*b* and 136*c* and respective sloping surfaces 138*a*, 138*b* and 138*c* on traction hoop 131 is shown to be at an angle to each other. However, this relationship can be varied based on the desired shock absorption and stability and these surfaces may be related to result in any desired configuration including a curved, planar, angular or jagged surface.

Indentations 127 may be provided in traction hoop 131 to form individual lugs 128*a*, 128*b* and 128*c*, which have outermost surfaces 136*a*, 136*b* and 136*c*. Indentations 127 allow lugs 128*a*, 128*b* and 128*c* to move relatively independently from one another. However, lugs 128*a*, 128*b* and 128*c* may comprise a single continuous lug or any desired quantity of lugs to satisfy the desired degree of shock absorption, stability and expansion of pods 121 and 122 or lugs 128*a*, 128*b* and 128*c*. As well, indentions 127 may comprise any size, dimension or placement. Furthermore, although the figures show cavities 130*a*, 130*b* and 130*c* disposed substantially above lugs 128*a*, 128*b* and 128*c* and struts 132 disposed substantially above indentations 127, any combination of placement is within the scope of the invention. Generally, the crescent shaped traction hoop 131 has an outer edge. As shown, the outer edge comprises outer edges 134*a*, 134*b* and 134*c*. In addition, as discussed above, pods 121 and 122 may include outermost surfaces 136*a*, 136*b* and 136*c* and sloping surfaces 138*a*, 138*b* and 138*c*. It is understood that these features on pods 121 and 122 will vary based on the quantity and configuration of lugs.

Figure 11:
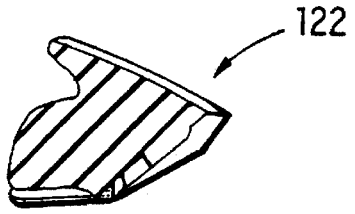
FIG. 11 is a cross-sectional view taken along line 11—11 shown in FIG. 9.
Figure 12:
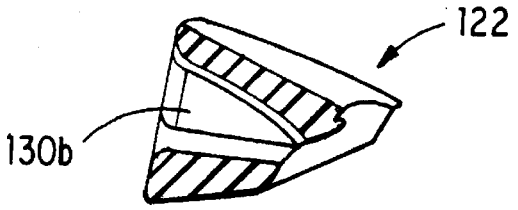
FIG. 12 is a cross-sectional view taken across line 12—12 shown in FIG. 9.
Figure 13:
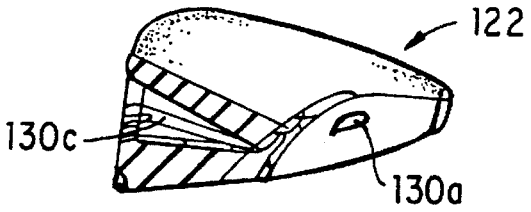
FIG. 13 is a cross-sectional view taken along line 13—13 as shown in FIG. 9.

FIGS. 11–13 show cross-sections through one of pods 121 and 122.

Figure 16:
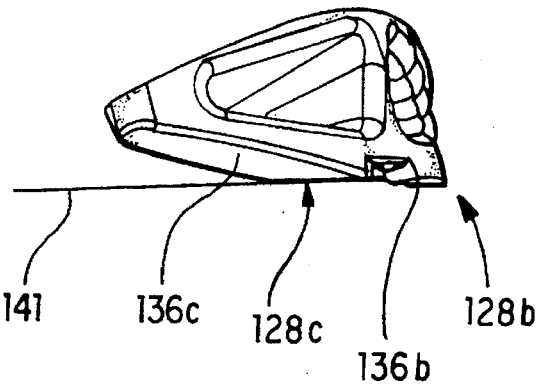
FIG. 16 is an end view of the pod shown in FIG. 14.
Figure 14:
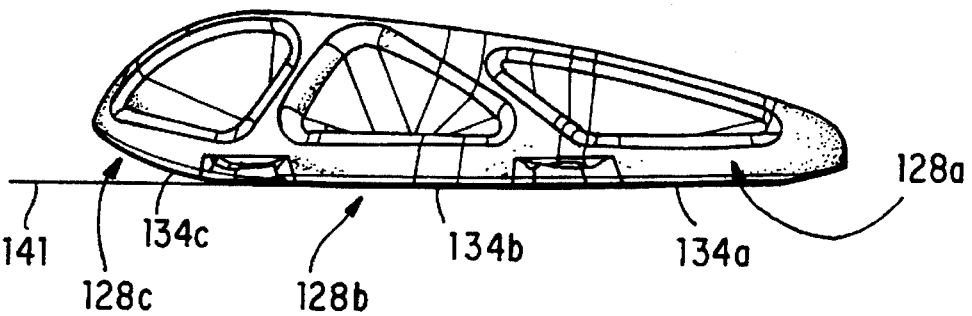
FIG. 14 is a side view of the pod resting on a planar surface.
Figure 15:
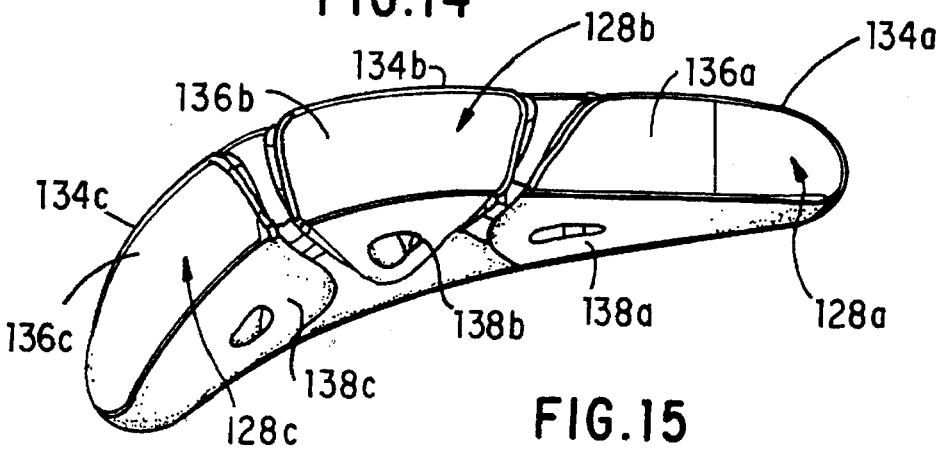
FIG. 15 is a bottom view of the pod shown in FIG. 14.

Referring now to FIGS. 14–16, one of pods 121 and 122 is shown resting on its traction hoop 131 on a planer surface. As best shown in FIGS. 14 and 16, pods 121 and 122 are configured such that when one of pods 121 and 122 is resting on a substantially planer surface 141, outermost surfaces 136*a* and 136*b* rest on substantially planar surface 141, while outermost surface 136*c* is spaced apart from substantially planar surface 141. Sloping surfaces 138*a*, 138*b* and 138*c* (shown in FIG. 15) may extend at a greater angle than outermost surfaces 136*a*, 136*b* and 136*c* and thereby extend in a direction away from planar surface 141. As discussed above, the relationship between the sloping surfaces 138*a*, 138*b* and 138*c* and outermost surfaces 136*a*, 136*b* and 136*c* may vary from the relationship that is illustrated.

Figure 17:
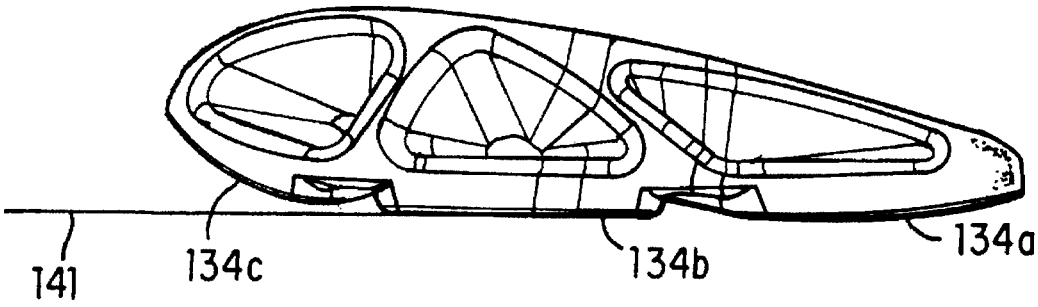
FIG. 17 is a side view of a preferred orientation of the pod where the pod is rotated about its edge.
Figure 18:
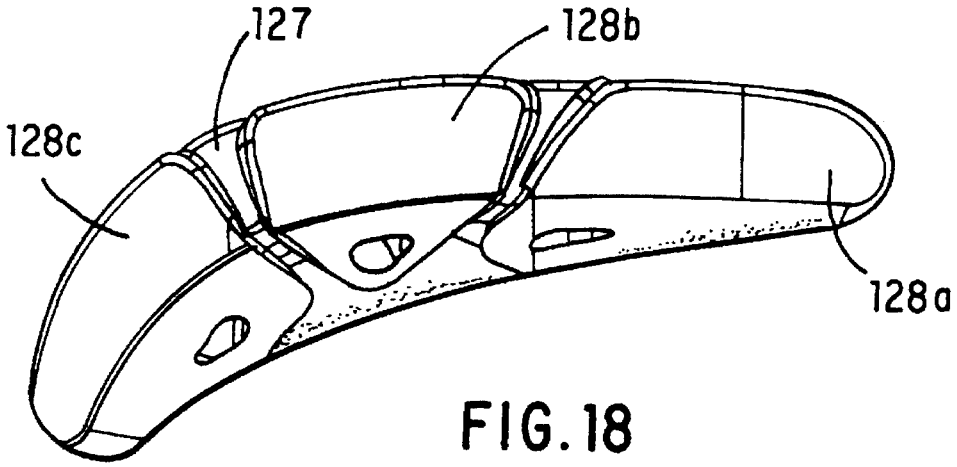
FIG. 18 is a bottom view of the preferred orientation of the pod shown in FIG. 17.
Figure 19:
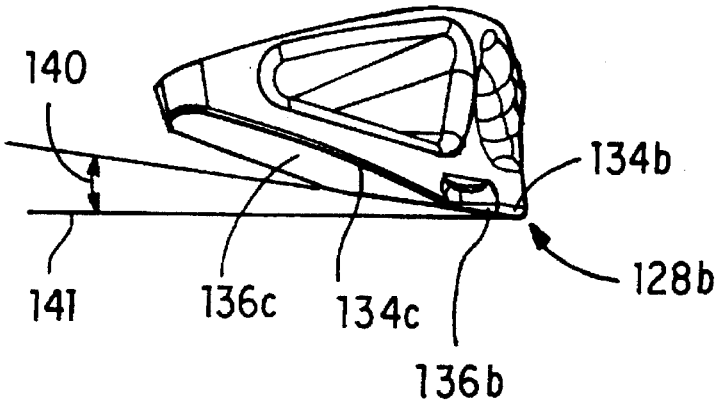
FIG. 19 is an end view of the preferred orientation of the pod shown in FIG. 17.

An embodiment of the invention shown in FIGS. 17–19 illustrates a mounting orientation for pods 121 and 122 on sole 105 or midsole 106. In the embodiment shown, when pods 121 and 122 are mounted on sole 105 or midsole 106, preferably, pods 121 and 122 may be effectively rotated about outer edges 134*a* and 134*b* such that at least outermost surface 136*b* is approximately at an angle 140 to substantially planar surface 141. By rotating pods 121 and 122, lug 128*c* is raised slightly off of substantially planar surface 141. Preferably, angle 140 is approximately 7°, however, based on the desired shock absorption and expansion of pods 121 and 122 under pressure, while taking into account other possible structural modifications discussed herein, angle 140 can be varied accordingly. Pods 121 and 122 also may be constructed such that a greater or lesser amount of pods 121 and 122 contact the ground or substantially planar surface 141. Pods 121 and 122 may also be disposed on a piece of footwear with any desired orientation to achieve the desired shock absorption and stability.

In addition, although a first embodiment of the invention is shown in FIGS. 1–19, as discussed above, it is within the scope of the invention to vary the height and length of pods 121 and 122, the quantity of cavities 130*a*, 130*b* and 130*c* in pods 121 and 122, the location and angle of struts 132, and the material comprising pods 121 and 122. In particular, placement of cavities 130*a*, 130*b* and 130*c* and struts 132 allow for a predictable and controllable amount of stability and shock absorption of pods 121 and 122.

In addition, FIGS. 1–18 show pods 121 and 122 being attached to midsole 106. As discussed above, pods 121 and 122 may be connected to sole 105. Nonetheless, pods 121 and 122 may be connected to midsole 106 or sole 105 by any suitable means. For example, pods 121 and 122 may be adhesively secured or bonded to midsole 106 or sole 105. A recess and projection interlocking combination may be provided to anchor the connection. Pods 121 and 122 may be formed integrally with midsole 106 or sole 105. In addition, pods 121 and 122 may be adapted to be integral with or connected to any type of sole 105 or may alone comprise sole 105 or midsole 106.

Furthermore, pods 121 and 122 may be connected to midsole 106 such that pods 121 and 122 may be removed and recycled or reused to obtain an environmentally compatible or "green" shoe. In particular, generally, shoes are thrown away, as are most things, and taken to waste sites, which are usually turned over or buried so the waste can compost or biodegrade. Most constituent shoe components, however, are biodegradable only over an extended period of time. Accordingly, in accordance with the invention, it is desirable to have an environmentally agreeable shoe construction such that portions of the shoe and/or the material used in the shoe may be more easily recyclable, reusable or replaceable. This will assist in reducing the amount of shoes and the amount of waste that will be disposed of in the finite amount waste sites available.

It is preferable to have at least parts of a shoe recyclable or reusable. For example, preferably at least the plastic, rubber or foam parts of the shoe are recyclable. In particular, these types of parts may be melted down or refurbished. However, ideally, the entire shoe may be recyclable and reusable. Shoe 102 may be constructed such that, for example, it is capable of being disassembled for recycling or such that it comprises materials that are amenable to recycling.

In particular, in accordance with the invention, shoe 102 may be segmentable. That is, shoe 102 may be constructed to have, for example, pods 121 and 122 removable from upper 104. In such case, parts of shoe 102 may be replaced, which may extend the life of shoe 102. Moreover, pods 121 and 122 may be separated into, for example, a plastics or rubber recycling bin while upper 102 may be separated into another bin. This initial sorting of parts of shoe 102 may assist in recycling and reuse of the parts or materials of shoe 102. It is within the scope of the invention to have any parts of shoe 102 segmentable for recycling, reuse or replacement. Furthermore, the entire sole 105, midsole 106, forefoot pad 109 or upper 102 may also be segmentable and/or reusable or recyclable. These recyclable features may be incorporated into any of the embodiments in accordance with the invention. It is further within the scope of the invention to provide incentives to encourage recycling.

Figure 20:
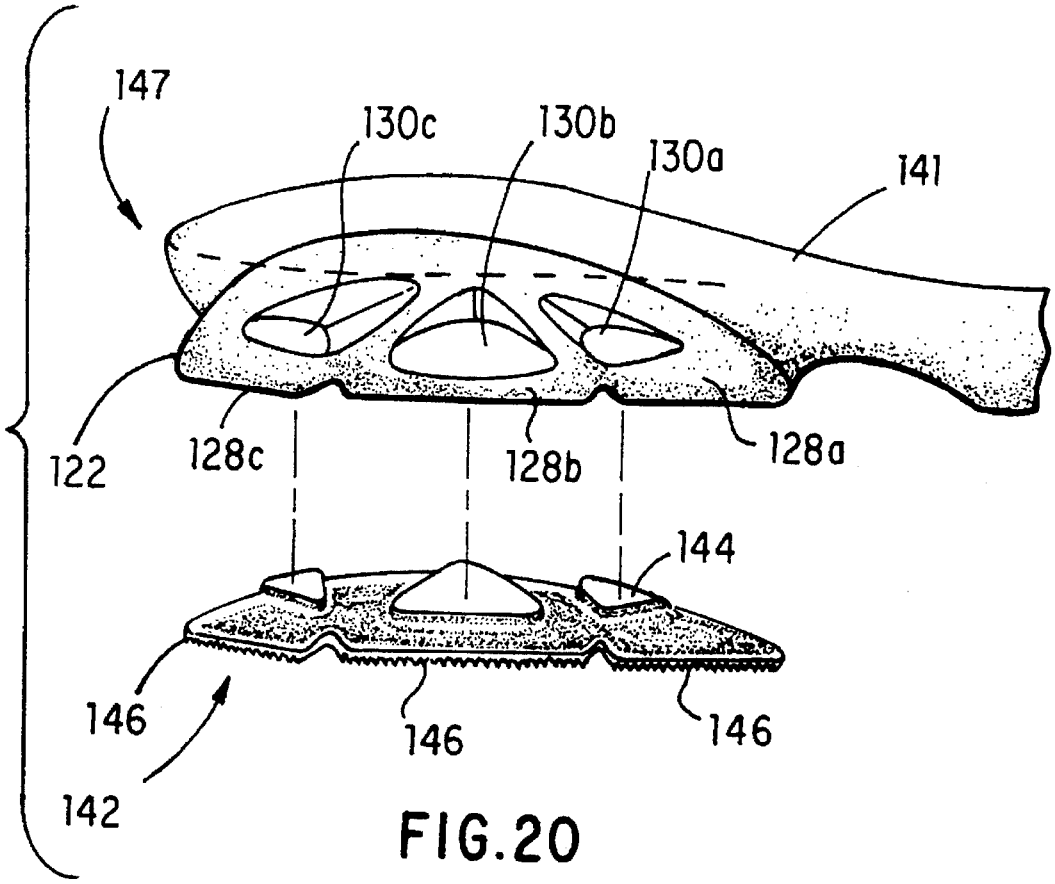
FIG. 20 is a side view of an outsole and midsole in accordance with an embodiment of a footwear construction.
Figure 21:
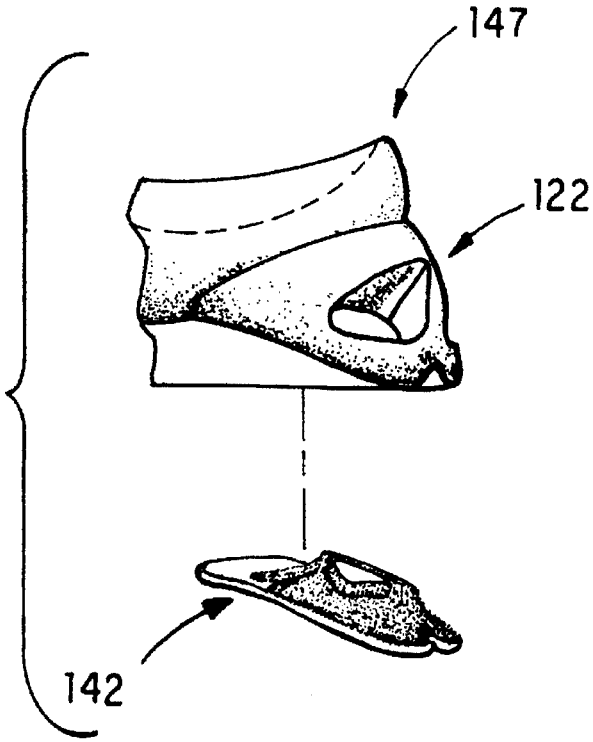
FIG. 21 is a portion of a rear view of the construction shown in FIG. 20.
Figure 22:
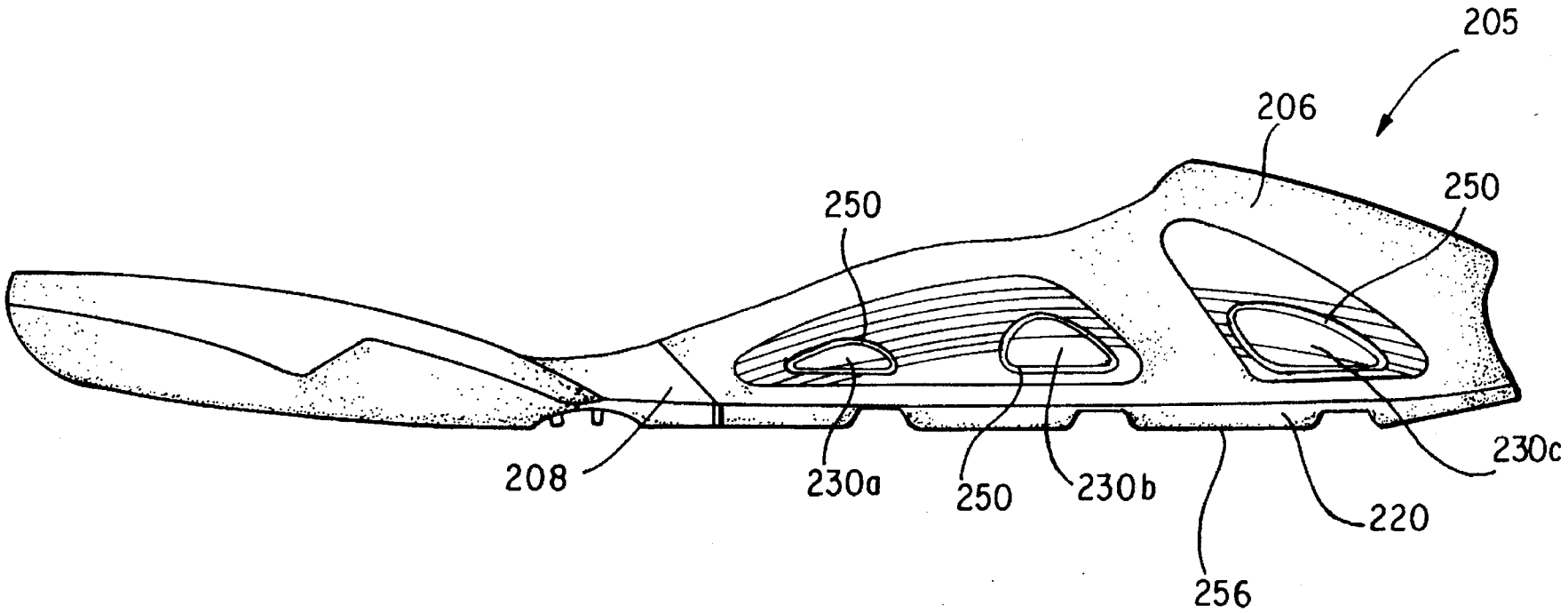
FIG. 22 is a side view of a footwear construction in accordance with a second embodiment of the invention.

As shown in FIGS. 20 and 21, sole 147 includes pods 121 and 122 that may be monolithic with midsole 141. In addition, it is within the scope of the invention that one or both of pods 121 and 122 may be monolithic with midsole 141. In a construction that does not include midsole 141, pods 121 and 122 may be partially or completely monolithic with any type of sole construction.

In addition, as shown in FIGS. 20 and 21, an outsole pad 142 may be provided. Outsole pad 142 may have protrusions 144 for being disposed in cavities 130*a*, 130*b* and 130*c*. In addition, outsole pad 142 may include lugs 146 corresponding to lugs 128*a*, 128*b* and 128*c* in pods 121 and 122. Protrusions 144 may extend partially or entirely into any of cavities 130*a*, 130*b* and 130*c*. Alternatively, outsole pad 142 can also have cavities formed therethrough which correspond to the shape of cavities 130*a*, 130*b* and 130*c* in pod 122. Outsole pad 142 may be provided on any of the embodiments in accordance with the invention.

Referring now to FIGS. 22–29, a second embodiment of a footwear construction is shown. Sole 205 may include midsole 206 and outsole 220 as shown. Sole 205 may be of a unitary or a combination construction. Sole 205 includes a medial side 208, a lateral side 210, and a bottom 219 (see FIGS. 25–27). Cavities 230*a*, 230*b* and 230*c* extend from sidewall 208 of sole 205 to bottom 219. To inhibit excessive compression at cavities 230*a*, 230*b* and 230*c*, support pieces 250 may be positioned within cavities 230*a*, 230*b* and 230*c*. These support elements 250 may take the form of a plastic tube which corresponds to the shape of cavities 230*a*, 230*b* and 230*c*. Support elements 250 may be substantially hollow cylinders which abut an inner surface of cavities 230*a*, 230*b* and 230*c*. However, support elements 250 may include partial cylinders, cylinders having supports within the hollow portion, columns, walls, to name only a few support type elements for being disposed in cavities 230*a*, 230*b* and 230*c*. Furthermore, support elements 250 may be disposed outside of the cavities 230*a*, 230*b* and 230*c* in midsole 206, for example, positioned around cavities 230*a*, 230*b* and 230*c*. In addition, supports elements 250 may be disposed in the embodiment having pods 121 and 122 or in any of the other embodiments in accordance with the invention. Since support elements 250 are provided to inhibit collapse of cavities 130*a*, 130*b* and 130*c* and/or to assist in the control of the amount of shock absorption, their use may be unnecessary or eliminated if sole 205 or midsole 206 is formed of a material sufficient to maintain the integrity of cavities 130*a*, 130*b* and 130*c* absent any additional support.

Figure 23:
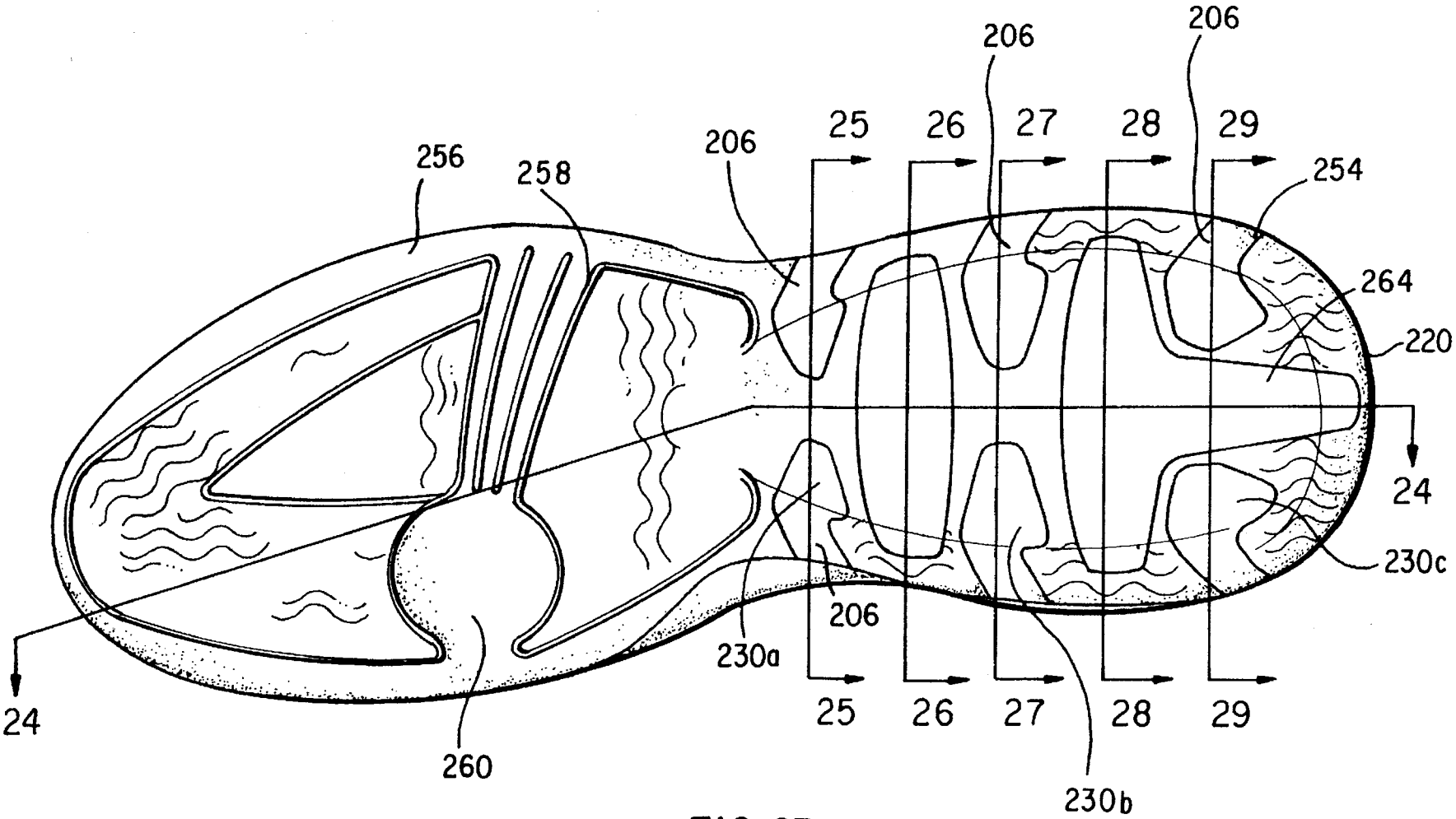
FIG. 23 is a bottom view in accordance with the second embodiment of the invention.
Figure 24:
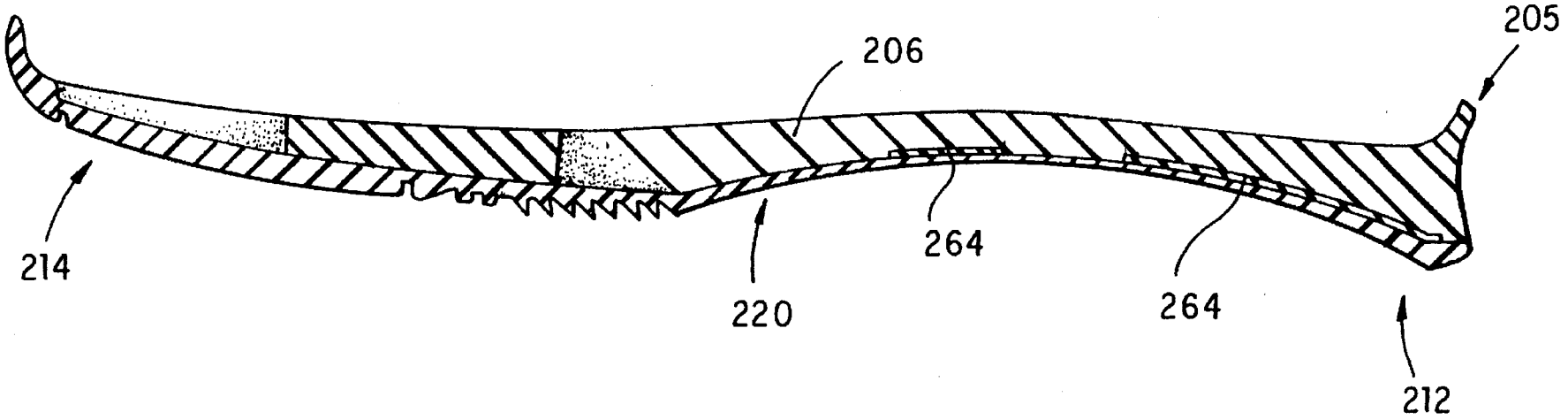
FIG. 24 is a cross-sectional view taken along line 24—24 shown in FIG. 23.
Figure 25:
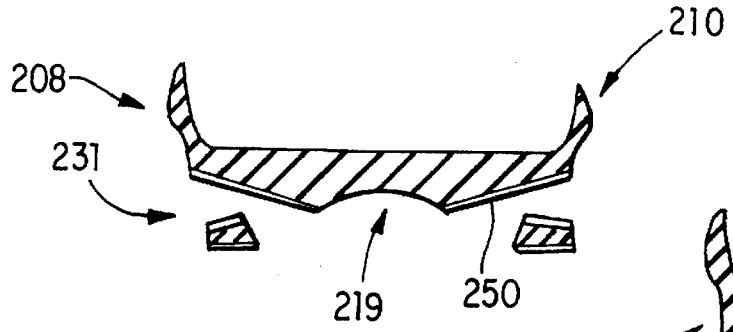
FIG. 25 is a cross-sectional view taken along line 25—25 shown in FIG. 23.
Figure 26:
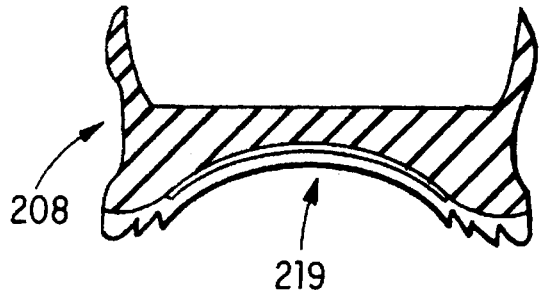
FIG. 26 is a cross-sectional view taken along line 26—26 shown in FIG. 23.

As shown in FIG. 23, part of midsole 206 and cavities 230*a*, 230*b* and 230*c* may be exposed through cutaway portions 254 in outsole 220. In the alternative, outsole 220 may cover midsole 206 or cavities 230*a*, 230*b* and 230*c* partially or entirely. Outsole 220 may have a lower surface 256 with flexure grooves 258 for enabling sole 205 to flex in the metatarsal region of the foot. A pivot cup 260 may be provided particularly on a tennis or basketball shoe. An insert 264 may be encapsulated in midsole 206, disposed between midsole 206 and outsole 220, encapsulated in outsole 220 or disposed in another part of sole 205. Insert 264 made of thermoplastic material, or composite graphite material, is used to help restore sole 205 to its unstressed condition after the application of a force. When a force is applied to midsole 206, insert 264 tends to spread outwardly. The material used to form the insert has good memory and therefore tends to quickly return to its original shape when the force is removed. Thus, insert 264 helps midsole 206 and outsole 220 recover to its unstressed state after the application of a force. As shown in FIG. 24, forefoot region 214 can include a different material from that of midsole 206. Other portions of sole 205 may also include different materials to provide different characteristics, which usually relate to cushioning. For example, sole 205 can include off-ratio polyurethane.

FIGS. 25–29 illustrate cross-sectional views of sole 205 shown in FIGS. 23–24. Cavities 230*a*, 230*b* and 230*c*, similar to cavities discussed above, may include various orientations and configurations. For example, cavities 230*a*, 230*b* and 230*c* can vary in size and shape, in addition, cavities 230*a*, 230*b* and 230*c* may be either discrete unconnected cavities or may be interconnected. As best shown, for example, in the FIG. 25 cross-sectional view, open ends 231 of cavities 230*a*, 230*b* and 230*c* may be on lateral and medial sides 208 and 210 and open ends 233 of cavities 230*a*, 230*b* and 230*c* may be on bottom 219 of sole 205. However, open ends 231 and 233 of cavities 230*a*, 230*b* and 230*c* may be located as desired to open in heel region 212, forefoot region 214 or anywhere along lateral and medial sides 208 and 210.

Figure 30:
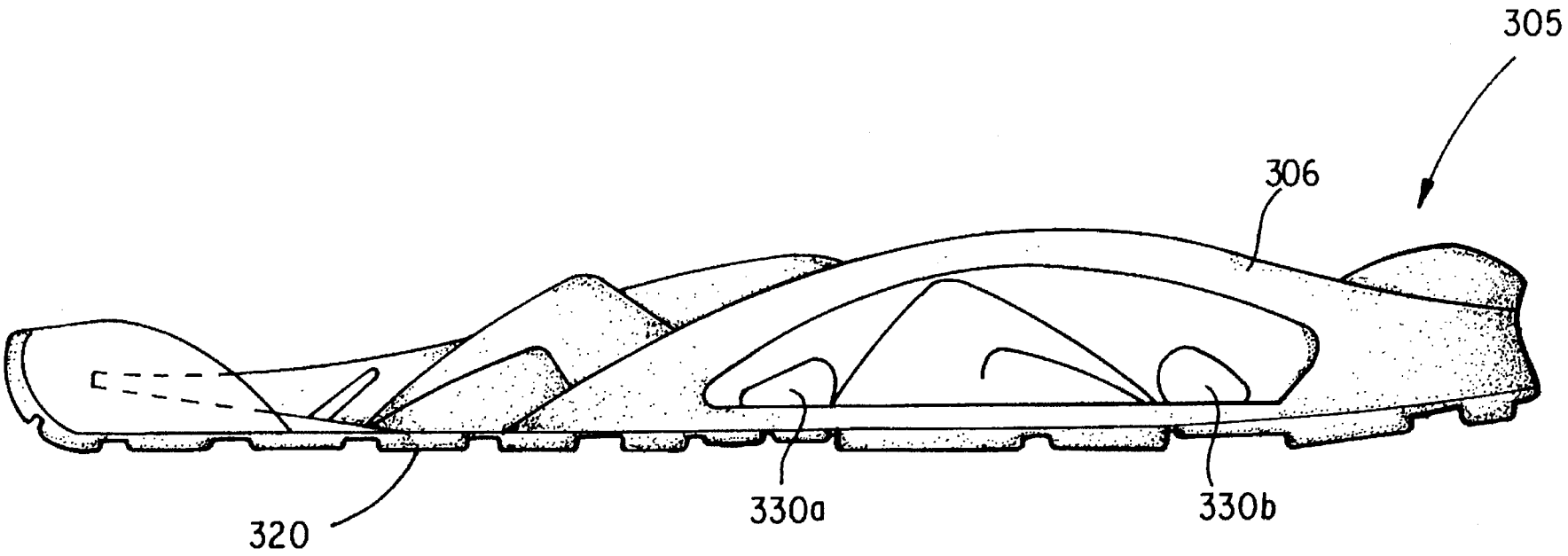
FIG. 30 is a side view of a footwear construction in accordance with a third embodiment of the invention.
Figure 31:
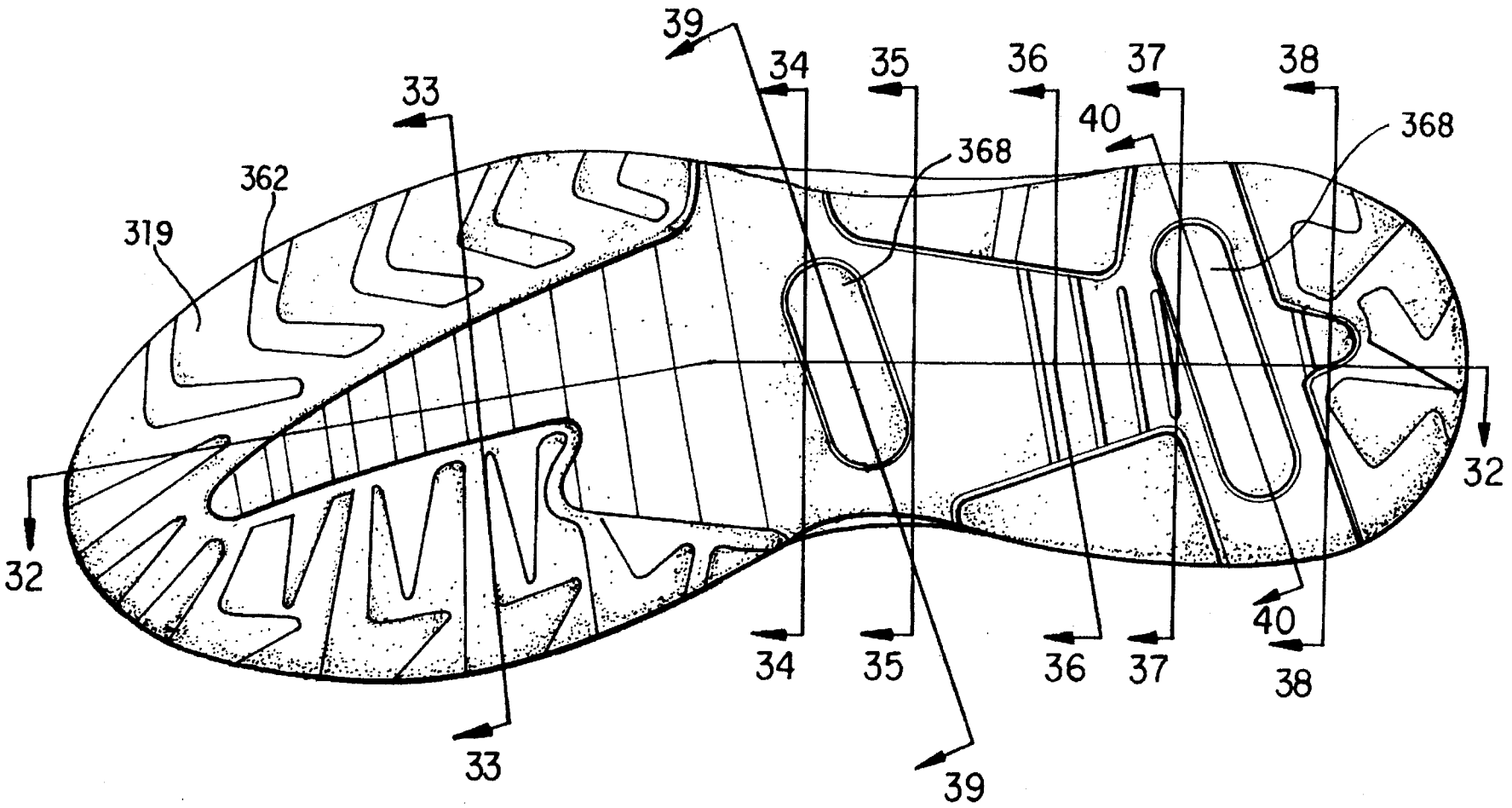
FIG. 31 is a bottom view in accordance with the third embodiment of the invention.
Figure 32:
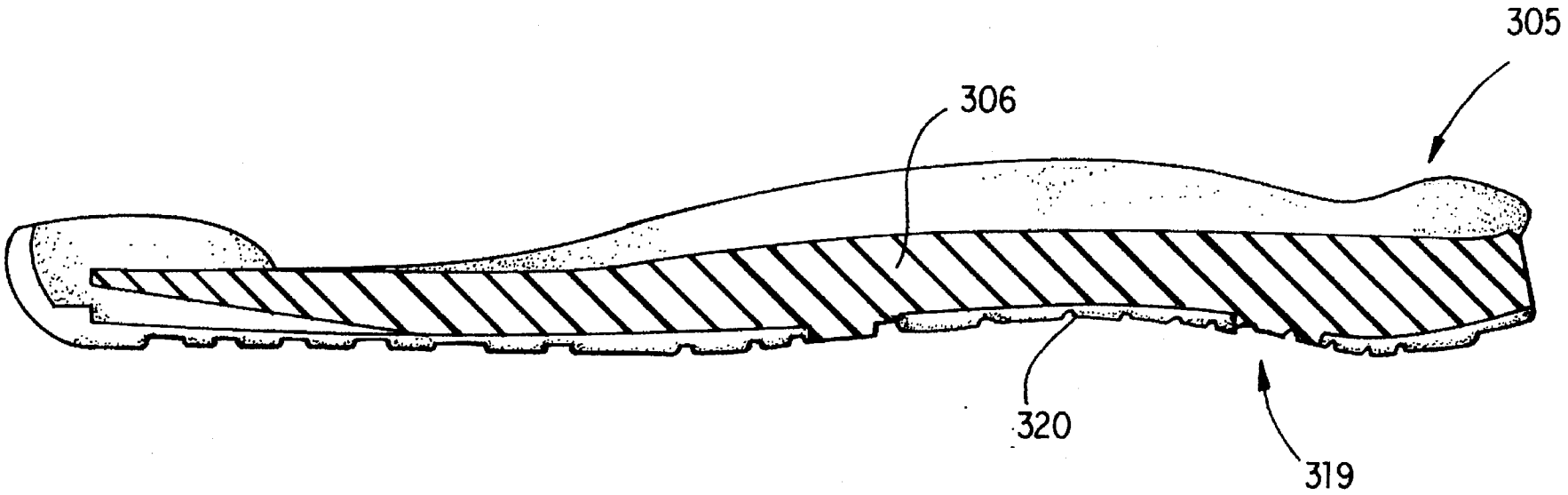
FIG. 32 is a cross-sectional view taken along line 32—32 shown in FIG. 31.
Figure 33:
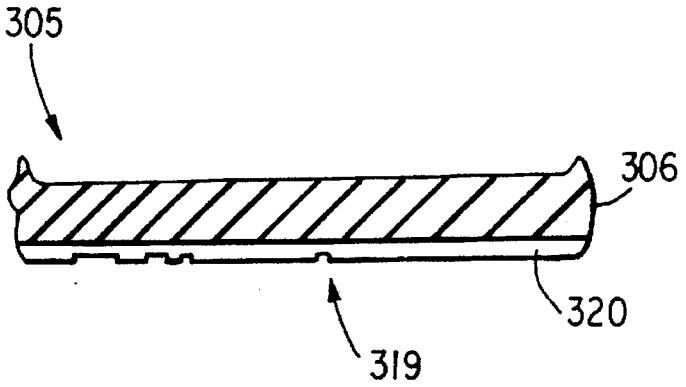
FIG. 33 is a cross-sectional view taken along line 33—33 shown in FIG. 31.
Figure 34:
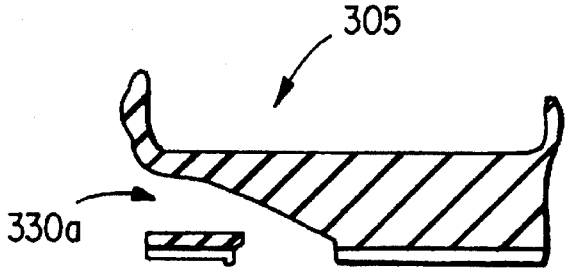
FIG. 34 is a cross-sectional view taken along line 34—34 shown in FIG. 31.
Figure 35:
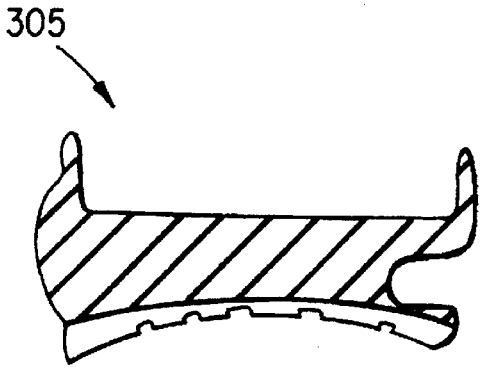
FIG. 35 is a cross-sectional view taken along line 35—35 shown in FIG. 31.
Figure 36:
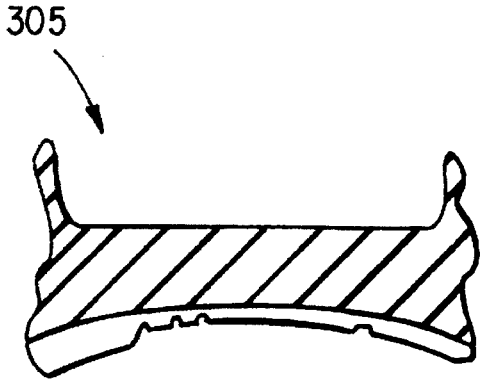
FIG. 36 is a cross-sectional view taken along line 36—36 shown in FIG. 31.
Figure 37:
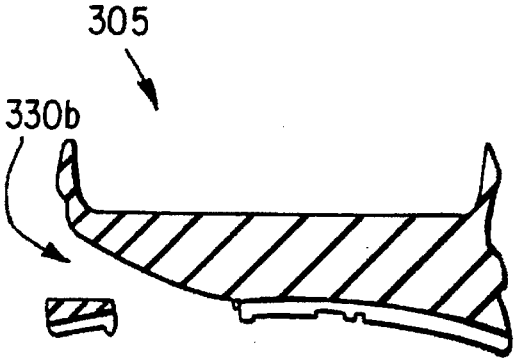
FIG. 37 is a cross-sectional view taken along line 37—37 shown in FIG. 31.
Figure 38:
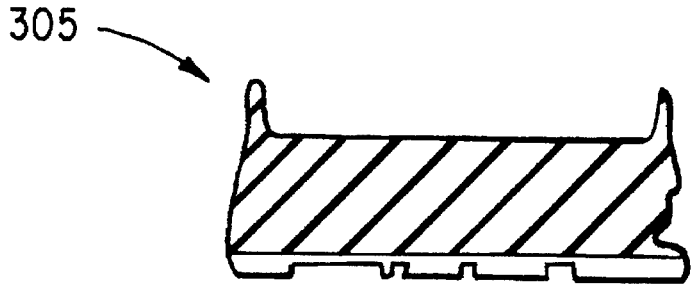
FIG. 38 is a cross-sectional view taken along line 38—38 shown in FIG. 31.

Referring now to FIG. 30 another footwear construction in accordance with a third embodiment of the invention is shown. Sole 305 may include midsole 306, and cavities 330*a* and 330*b*. As shown in FIG. 31, cavities 330*a* and 330*b* may extend diagonally from medial side 308 to lateral side 310. However, as discussed above, cavities 330*a* and 330*b* may extend in any direction and comprise any configuration to achieve the desired shock absorption as discussed above. Bottom 319 of sole 305, as best seen in FIG. 31, may have treads 362 and openings 368. Openings 368 in outsole 320 may expose part of midsole 306 and cavities 330*a* and 330*b*. However, outsole 320 may partially or entirely cover midsole 306 or cavities 330*a* and 330*b*. In addition, openings 368 may comprise any size and shape.

Figure 39:
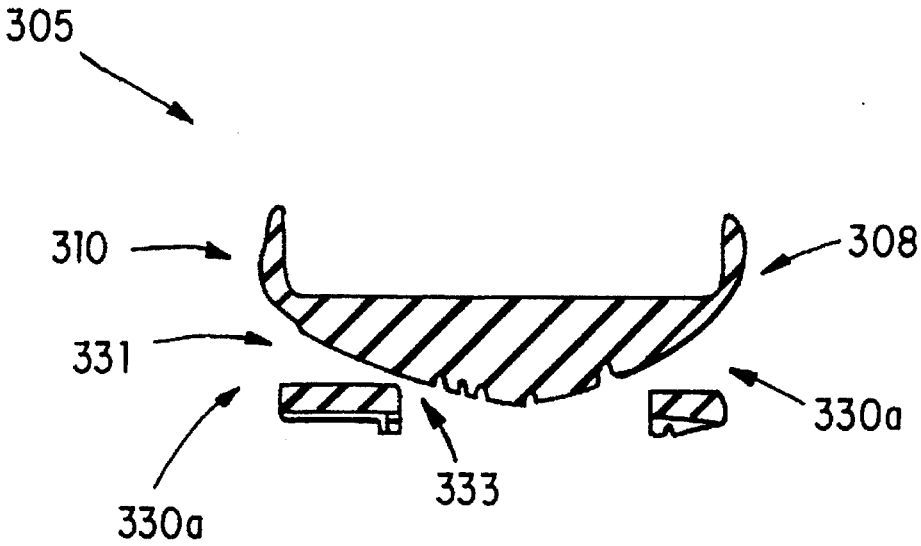
FIG. 39 is a cross-sectional view taken along line 39—39 shown in FIG. 31.
Figure 40:
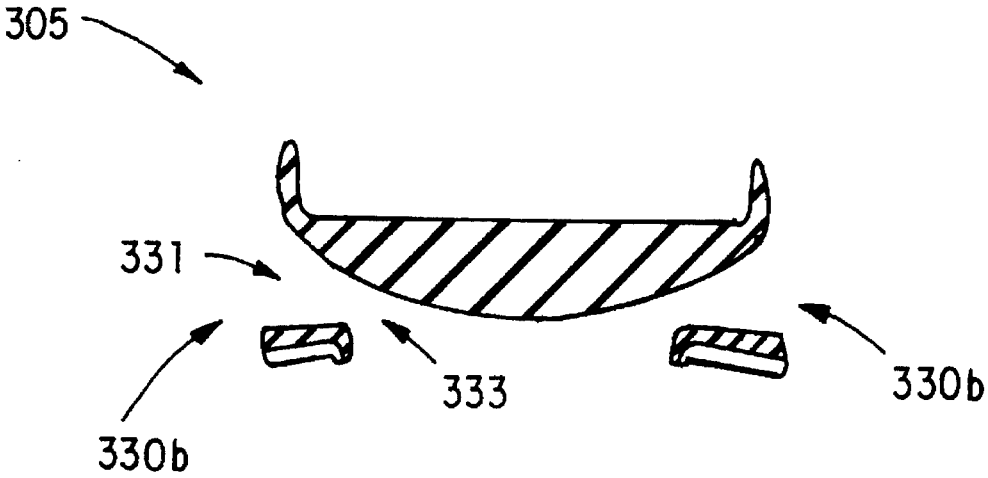
FIG. 40 is a cross-sectional view taken along line 40—40 shown in FIG. 31.

FIGS. 32–40 show cross-sectional views of sole 305 in accordance with the third embodiment of the invention. Referring, to FIGS. 39 and 40, open ends 331 of cavities 330*a* and 330*b* may be disposed on lateral and medial sides 308 and 310 and open ends 333 of cavities 330*a* and 330*b* may be disposed on bottom 319 of sole 305. As discussed above, open ends 331 and 332 may be disposed where desired and the cavities 330*a* and 330*b* can be modified to achieve a desired shock absorption. This embodiment can further include straps, discussed in greater detail below with reference to FIGS. 71 and 72, for passing through cavities 303*a* and 303*b* to provide support under the arch or straps may surround the shoe to provide support to the entire foot.

Figure 41:
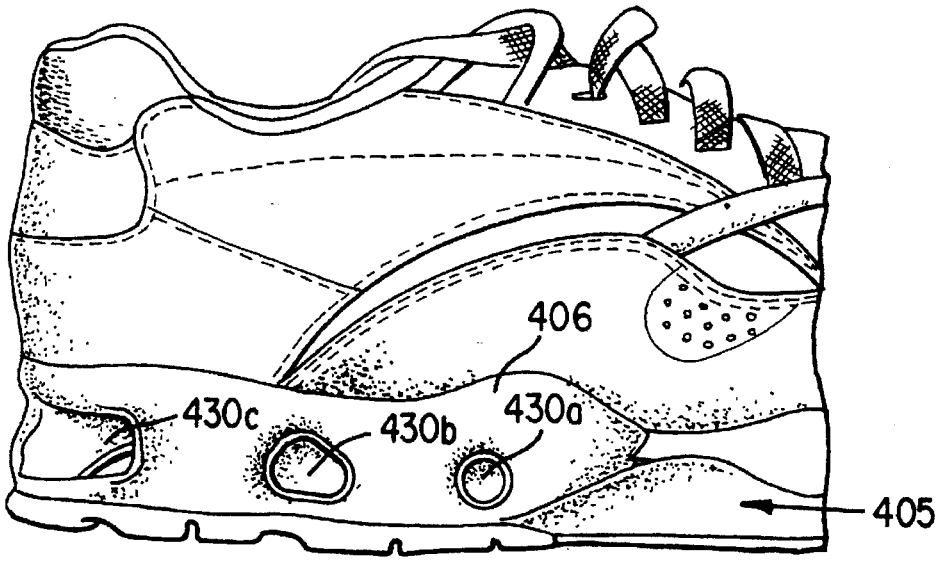
FIG. 41 is a side view of a footwear construction in accordance with a fourth embodiment of the invention.
Figure 42:
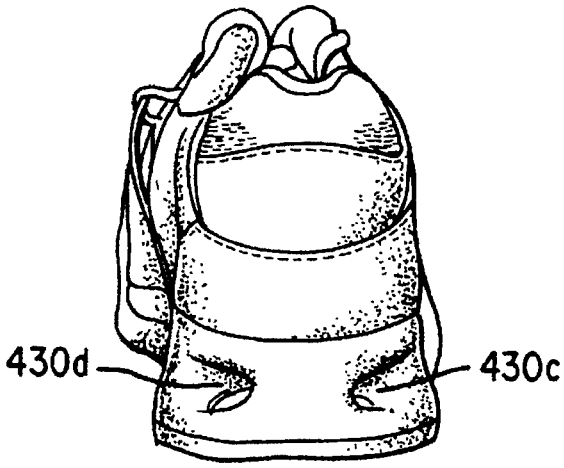
FIG. 42 is a rear view in accordance with the fourth embodiment of the invention.

Now referring to FIGS. 41–45, a fourth embodiment of a footwear sole construction is shown. FIGS. 41 and 42 show upper 404 and midsole 406. Midsole 406 includes cavities 430*a*, 430*b*, 430*c*, 430*d*, 430*e* and 430*f*, with open ends 431, which may be disposed along lateral side 410, a rear part and medial side 408 of heel region 412. Although cavities 430*a*, 430*b* and 430*c* are disposed substantially symmetrically to cavities 430*d*, 430*e* and 430*f* in midsole 406, more cavities may be disposed on lateral side 410, for example, to provide more stability and shock absorption upon impact. Other variations may be incorporated based on the desired shock absorption. A support element 470, best shown in FIG. 43, may be a plate-like configuration disposed on lower surface 418 of midsole 406. Preferably, support element 470 is curved to incorporate a preferred convex construction on a bottom 419 of shoe 402. Support element 470 may comprise a number of different materials including thermoplastic carbon fiber, steel, etc. Preferably, support element 470 is substantially rigid to support lower surface 419 of midsole 406 in a convex configuration. If support element 470 is of a resilient material, support element 470 may work with cavities 430*a*, 430*b*, 430*c*, 430*d*, 430*e* and 430*f* to provide shock absorption and stability. However, support element 470 may vary in size and configuration or be eliminated entirely from sole 405. In addition, support element 470 can extend partially or fully over any part of sole 405.

Cavities 430*a*, 430*b* and 430*c* may extend through midsole 406 and support element 470. Open ends 433 may be disposed through support element 470, however, open ends 433 may only extend partially or not at all into support element 470. Outsole 420 has an opening 471, which exposes part of reinforcement element 470 and open ends 433 of cavities 430*a*, 430*b* and 430*c*. However, outsole 420 may not have an opening 471 or may have a different size or configuration opening 471 than shown.

Figure 43:
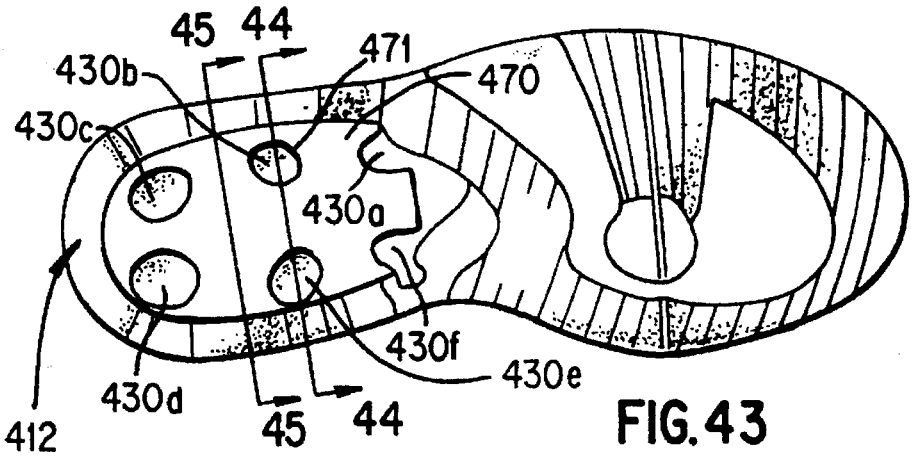
FIG. 43 is a bottom view in accordance with the fourth embodiment of the invention.
Figure 44:
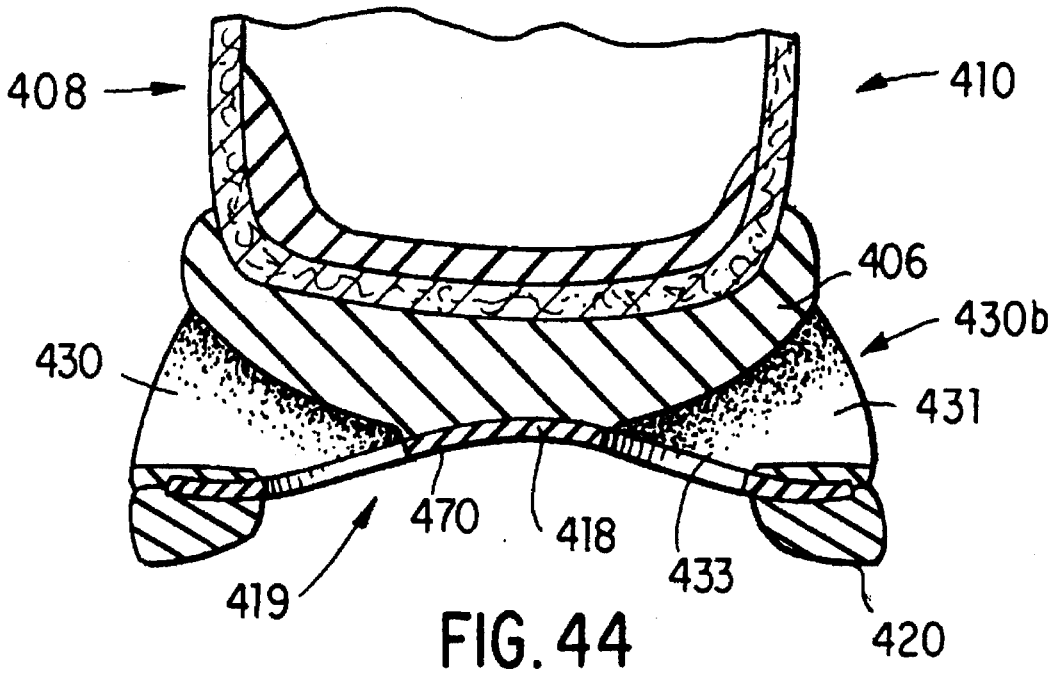
FIG. 44 is a cross-sectional view taken along line 44—44 shown in FIG. 43.
Figure 45:
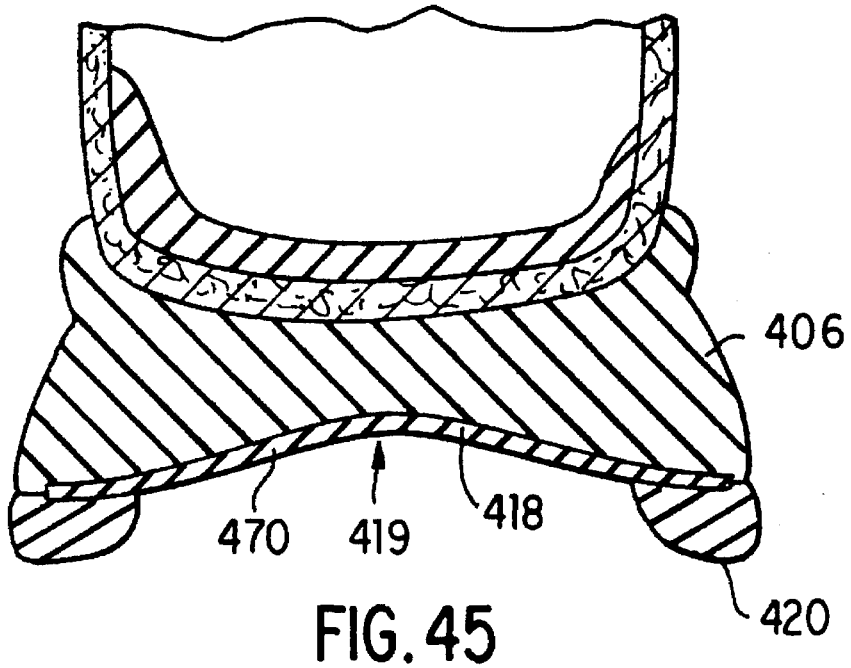
FIG. 45 is a cross-sectional view taken along line 45—45 shown in FIG. 43.
Figure 46:
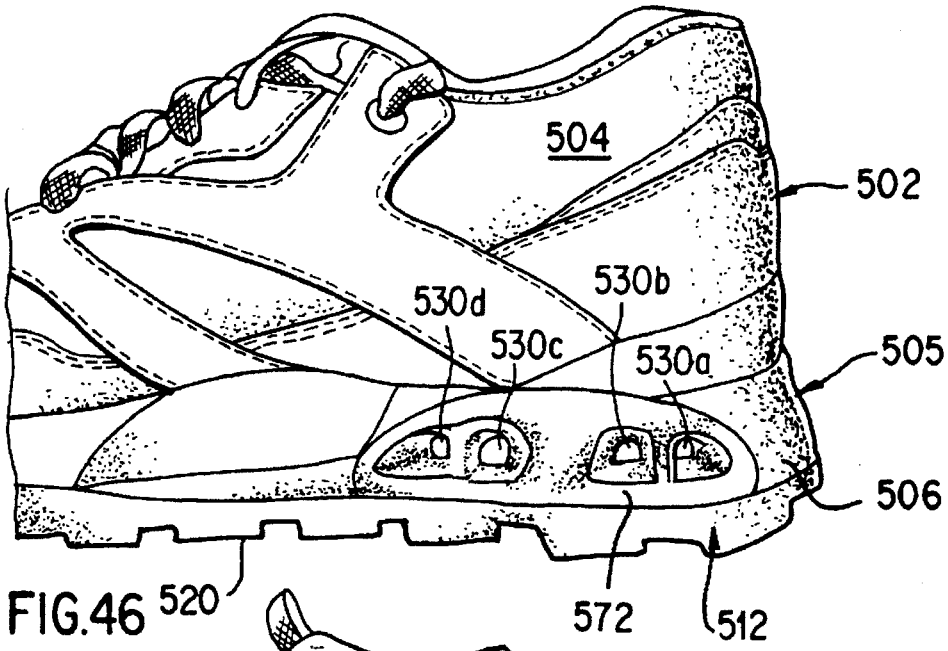
FIG. 46 is a side view of a footwear construction in accordance with a fifth embodiment of the invention.
Figure 47:
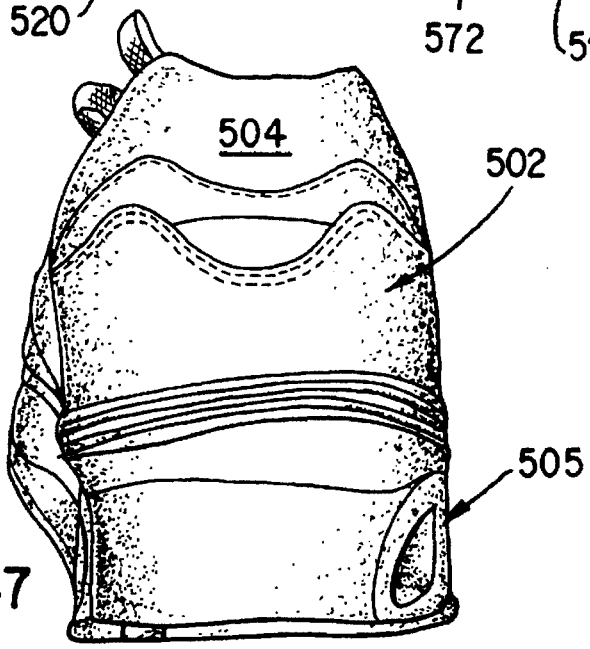
FIG. 47 is a rear view in accordance with the fifth embodiment of the invention.
Figure 48:
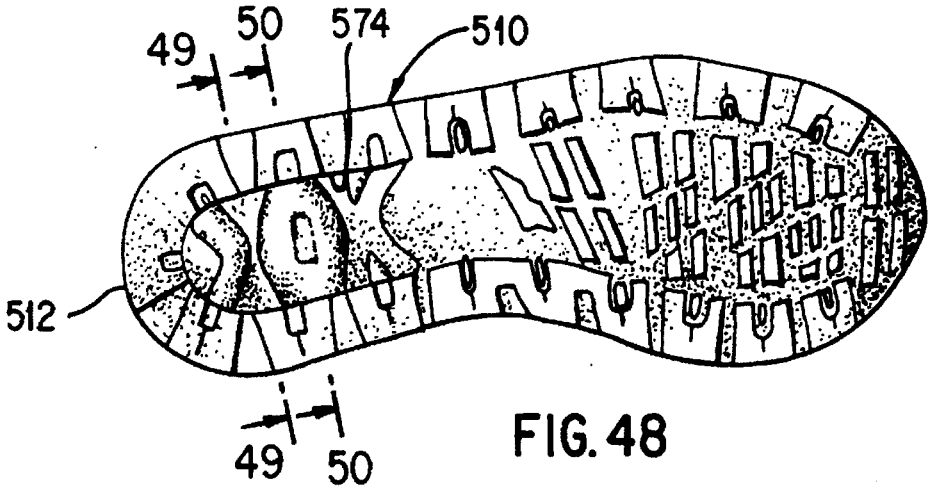
FIG. 48 is a bottom view in accordance with the fifth embodiment of the invention.

FIGS. 44 and 45 show cross-sections of the embodiment of shoe 402 shown in FIGS. 41–43. These figures illustrate the convex bottom portion of shoe 402. However, bottom 419 of sole 405 may not be convex.

Now referring to FIGS. 46–50, a footwear construction in accordance with a fifth embodiment of the invention is shown. Shoe 502 may include upper 504 and sole 505. Sole 505 may include midsole 506. A support element 572 may be disposed in heel region 512 of sole 505. Although the figures show sole 505 in accordance with the fifth embodiment to be a combination of elements, sole 505 may be formed as a unitary structure or in any number of parts.

Support element 572, as shown, may extend from medial side 508 to lateral side 510, however, it is within the scope of the invention that support element 572 may vary in size so as to extend to the end of heel region 512 and/or to the end of forefoot region 514. In addition, support element 572 may comprise a plurality of support elements, for example, a support element 572 both in forefoot region 514 and heel region 512.

Outsole 520 may include an opening 574 exposing part of support element 572 and midsole 506. However, outsole 520 may not include an opening 574 at all or may include a different size opening 574.

Figure 49:
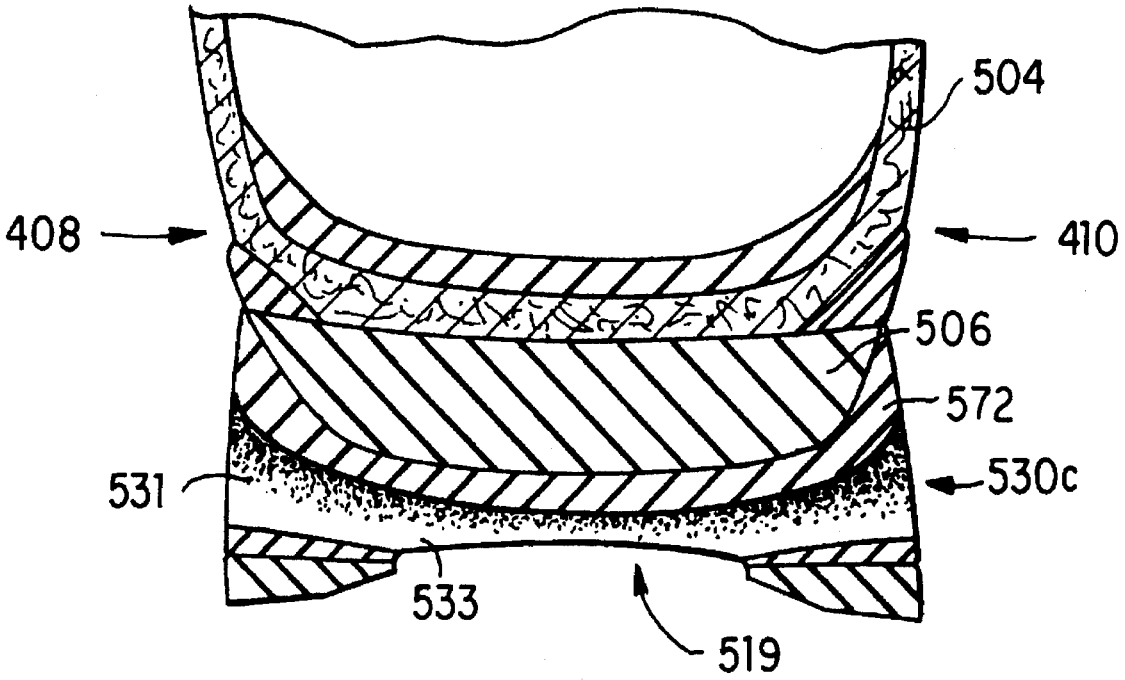
FIG. 49 is a cross-sectional view taken along line 49—49 shown in FIG. 48.

As shown in FIG. 49, cavities 530*a*, 530*b*, 530*c* and 530*d* extending through support element 572 may have open ends 531 on medial and lateral sides 508 and 510. In addition, open ends 533 are disposed to be on bottom 519 of sole 505. Again, as discussed above, cavities 530*a*, 530*b*, 530*c* and 530*d* may include any type of shape and configuration and open ends 531 and 533 may be disposed in any location such that the desired shock absorption is achieved.

Figure 50:
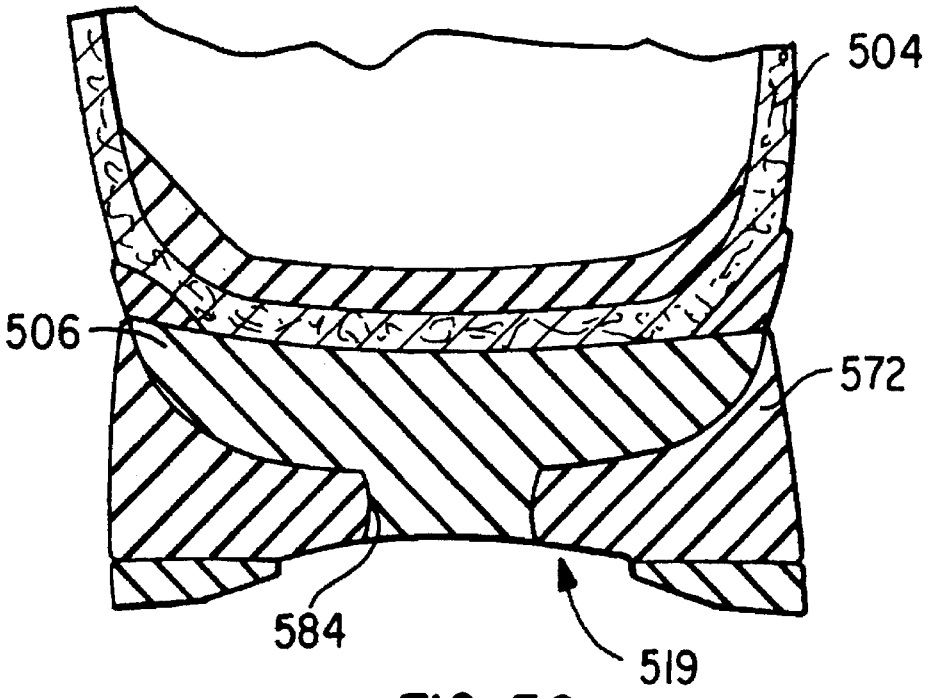
FIG. 50 is a cross-sectional view taken along line 50—50 shown in FIG. 48.
Figure 51:
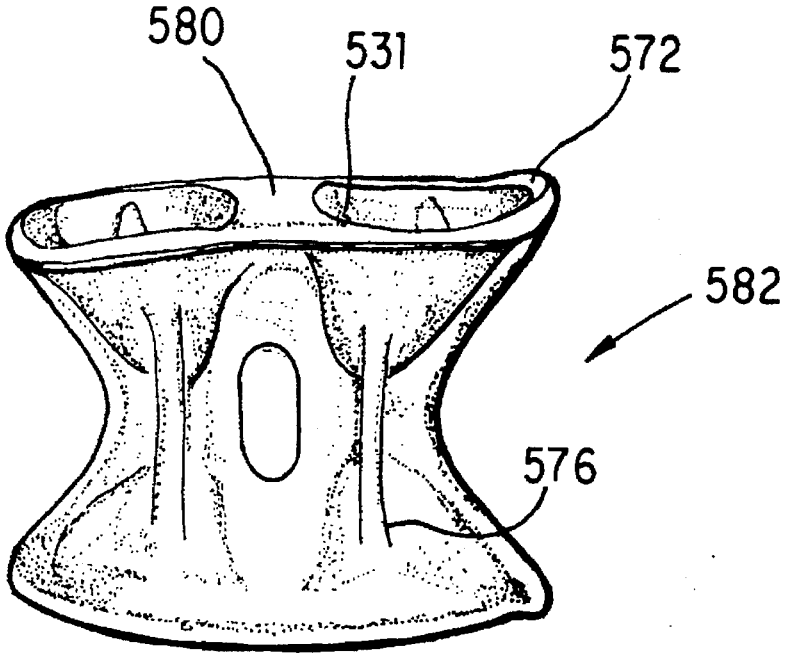
FIG. 51 is a top view of a sole element in accordance with the fifth embodiment of the invention.
Figure 52:
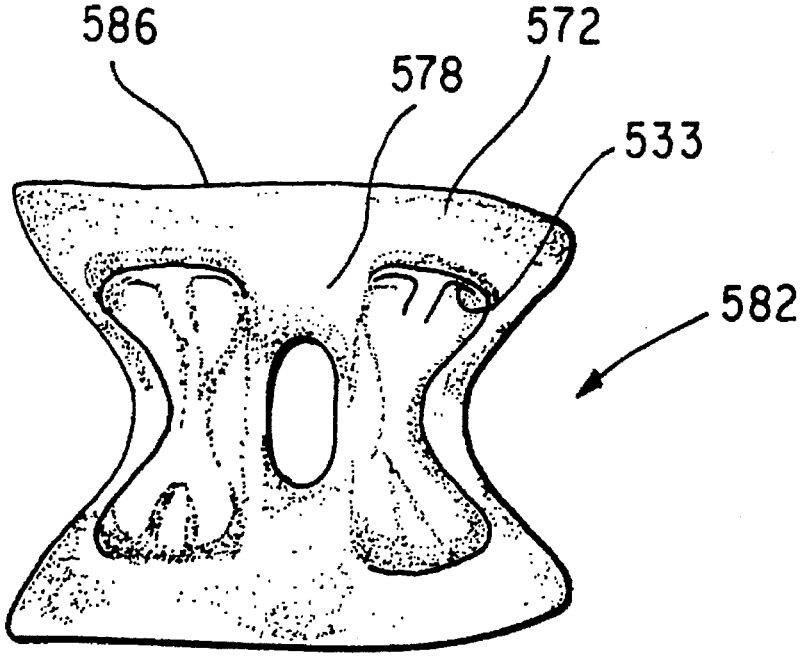
FIG. 52 is a bottom view of the sole element in accordance with the fifth embodiment of the invention.
Figure 53:
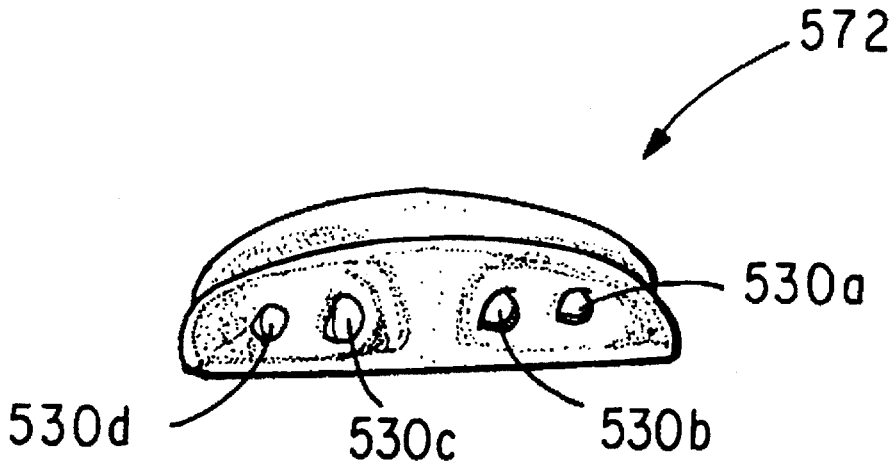
FIG. 53 is a side view of the sole element of the fifth embodiment of the invention.
Figure 54:
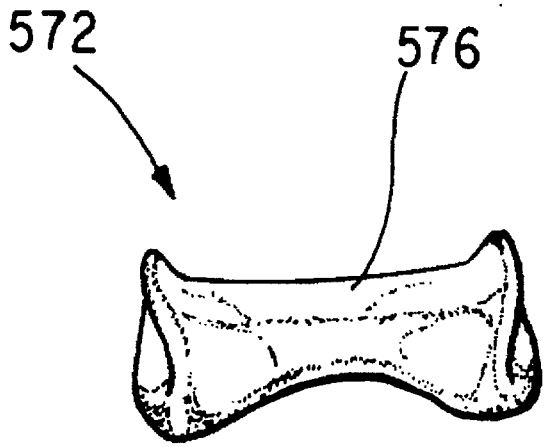
FIG. 54 is an end view of the sole element in accordance with the fifth embodiment of the invention.

As shown in FIG. 50, when support element 572 is disposed in sole 505, midsole 506 material or sole 505 material extends through an opening 584 in support element 572. This feature secures the connection between midsole 506 and support element 572. However, it is within the scope of the invention to secure support element 572 to midsole 506 in any conventional fashion including adhesive bonding, engaging protrusions and recesses, etc.

Support element 572 will be described in greater detail by referring to FIGS. 51–54. Support element 572 may include a top surface 576, a bottom surface 578, sides 580, ends 582, and opening 584. Sides 580 each include cavities 530*a*, 530*b*, 530*c* and 530*d*. Cavities 530*a*, 530*b*, 530*c* and 530*d* may be configured as discussed above and open ends 531 and 533 may be disposed as desired and discussed above.

Preferably, support element 572 is made of a material having a Shore A hardness value between 65 and 80. Preferably, support element 572 may be made of a rubber-like material such as MILLATHANE. However, it is within the scope of the invention to vary the Shore A hardness and the type of material used based on the desired shock absorption.

Figure 55:
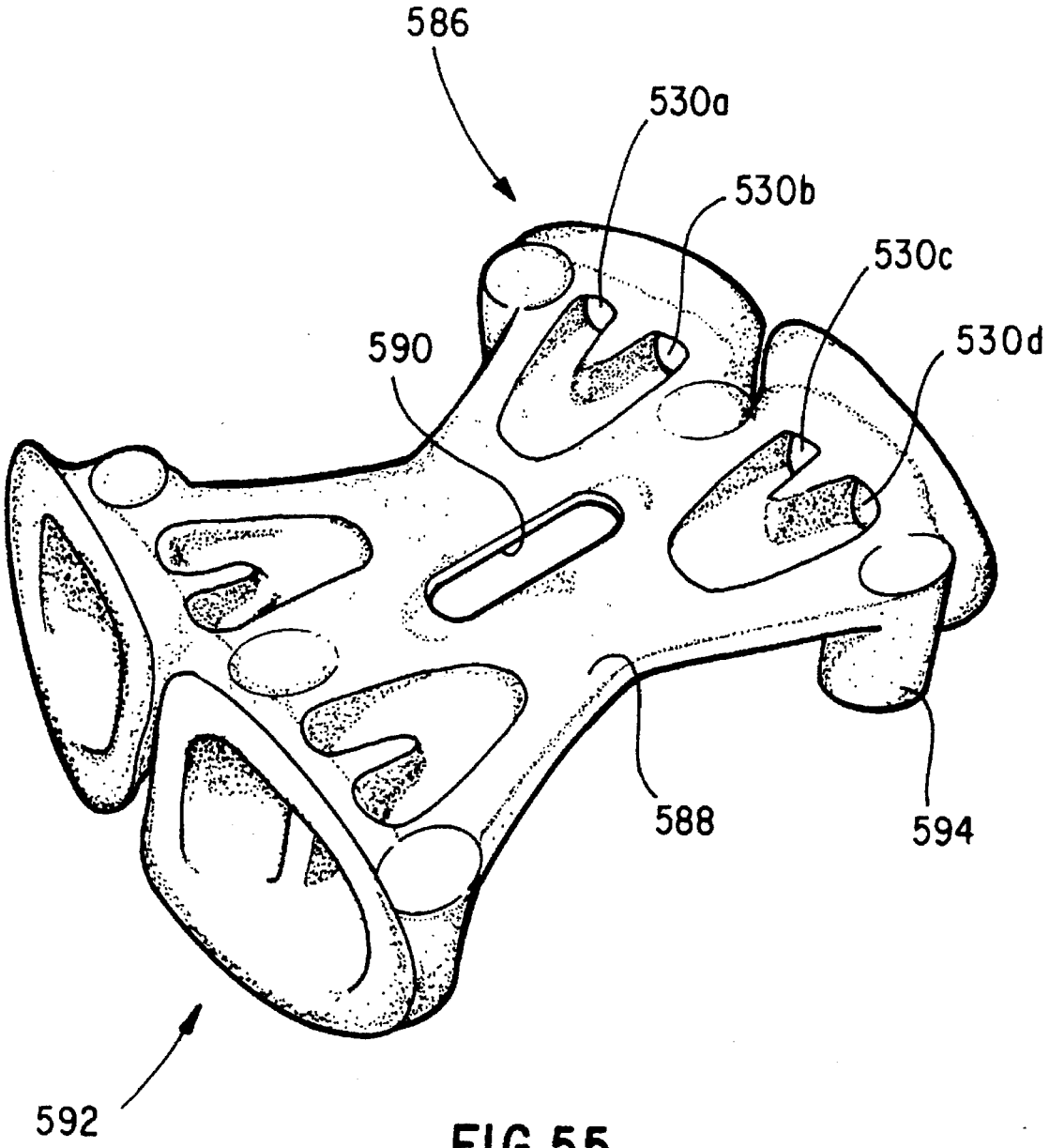
FIG. 55 is a modified embodiment of the sole element in accordance with the fifth embodiment of the invention.
Figure 56:
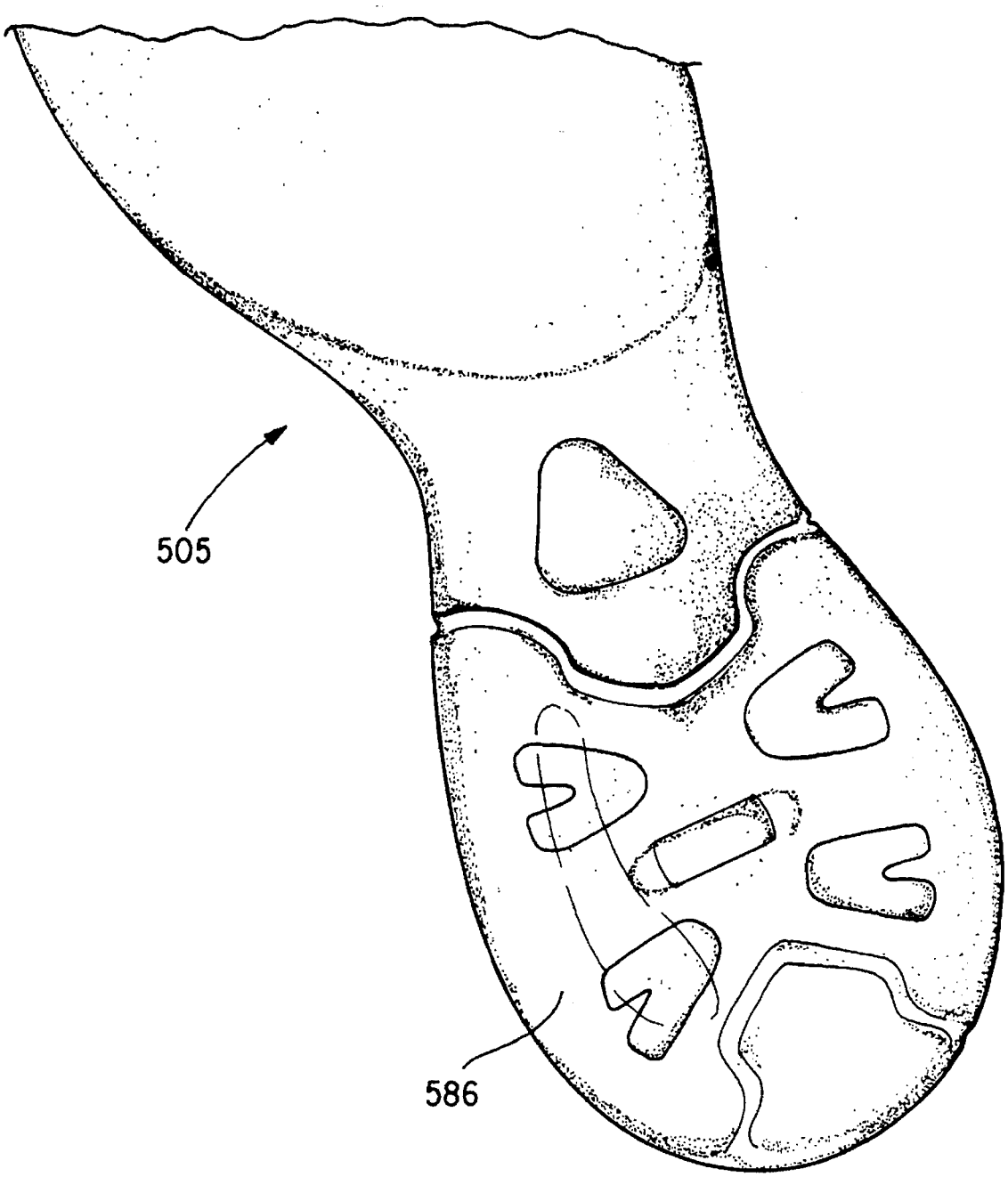
FIG. 56 is a bottom view of the footwear construction incorporating the sole element shown in FIG. 55.
Figure 57:
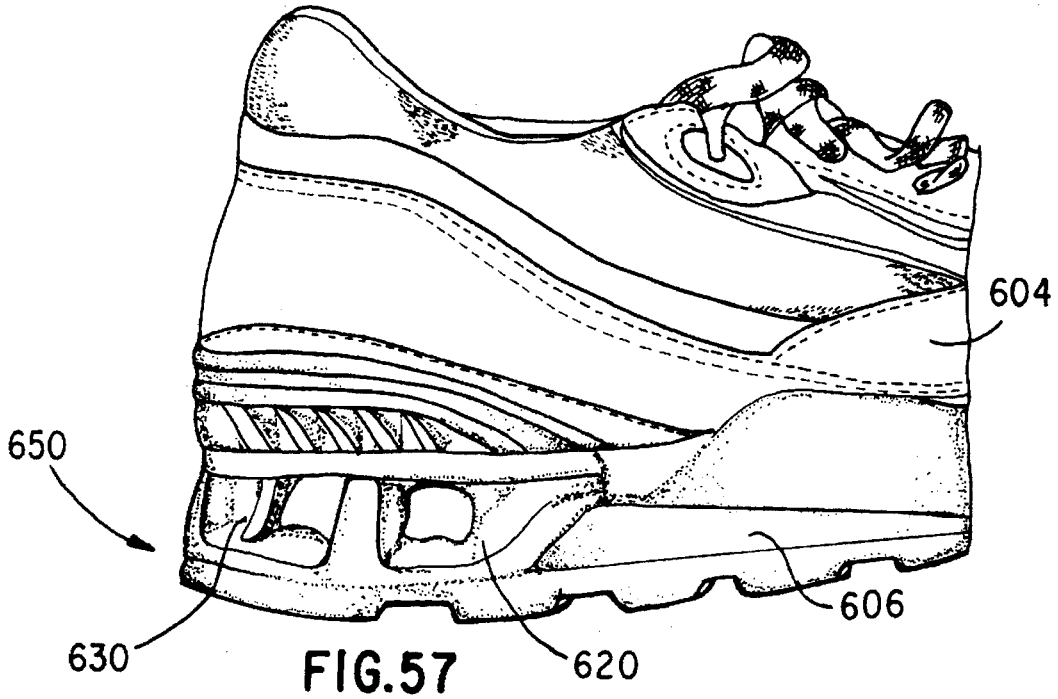
FIG. 57 is a side view of a void footwear sole construction in accordance with a sixth embodiment of the invention.
Figure 58:
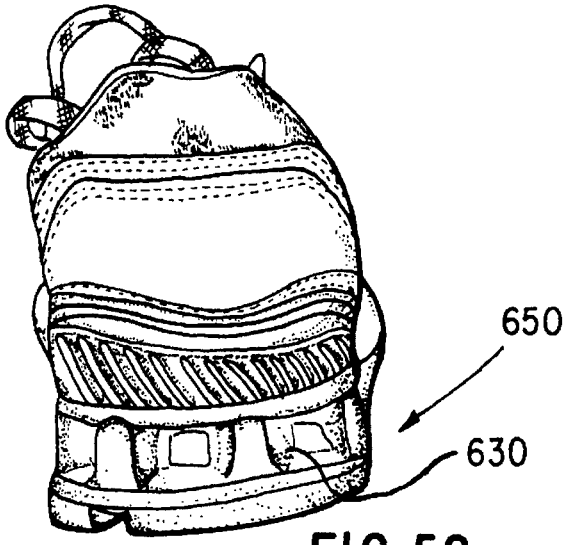
FIG. 58 is a rear view in accordance with the sixth embodiment of the invention.

FIGS. 55 and 56 show a modified embodiment of support element 572, shown as support element 586. In particular, support element 586 shown in FIG. 55 may include a bottom surface 588, an opening 590, sides 592 with cavities 530*a*, 530*b*, 530*c* and 530*d*, and pegs 594. Pegs 594 assist in positioning support element 586 in sole 505 during construction. However, support element 586 may be constructed without, for example, pegs 594 or opening 590. Opening 590 enables, for example, midsole 506 or sole 505 material to pass therethrough and anchor support element 586 to midsole 6 or sole 505. However, as discussed above, alternate embodiments such as a projection, a plurality of openings or a differently positioned opening may be used. FIG. 56 shows support element 586 disposed in sole 505.

Figure 59:
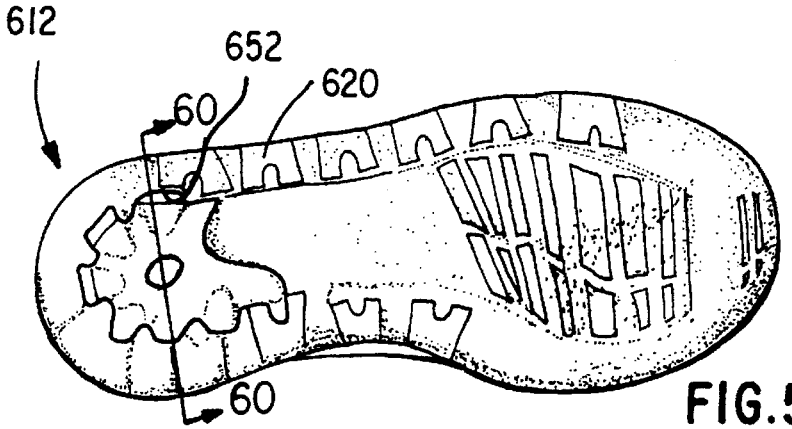
FIG. 59 is a bottom view in accordance with the sixth embodiment of the invention.
Figure 60:
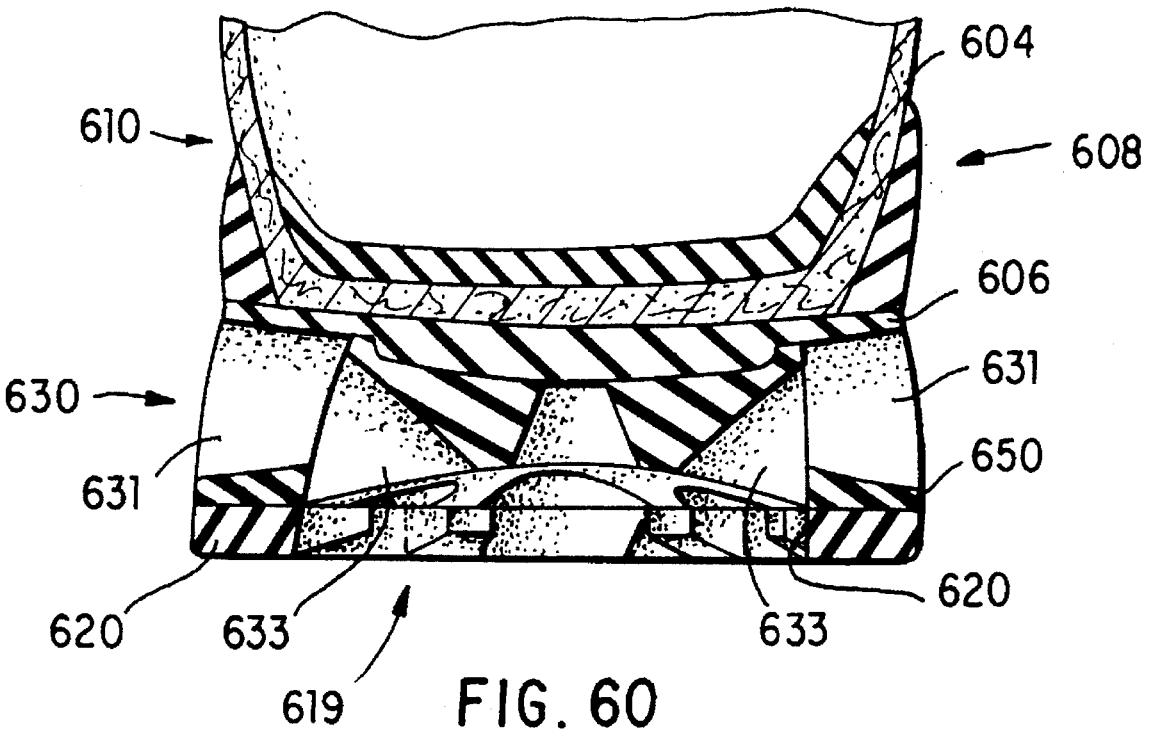
FIG. 60 is a cross-sectional view taken along line 60—60 shown in FIG. 59.
Figure 61:
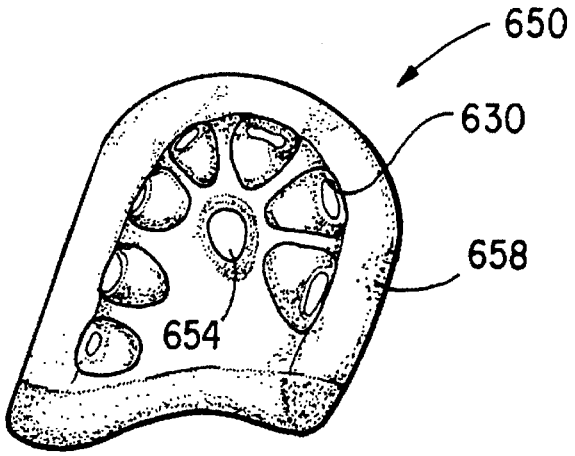
FIG. 61 is a bottom view of a sole element in accordance with the sixth embodiment of the invention.
Figure 62:
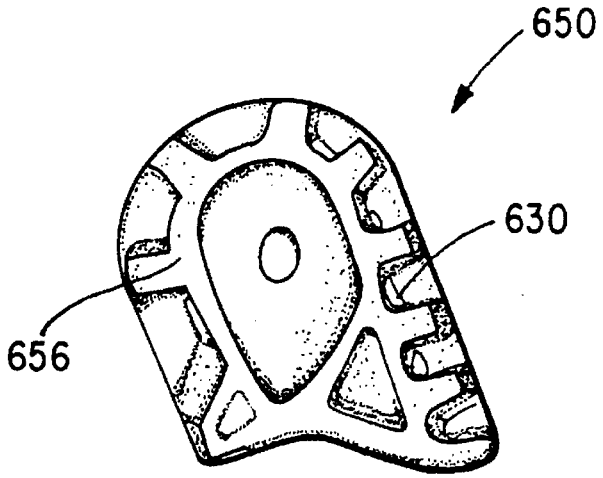
FIG. 62 is a top view of the top of the sole element in accordance with the sixth embodiment of the invention.
Figure 63:
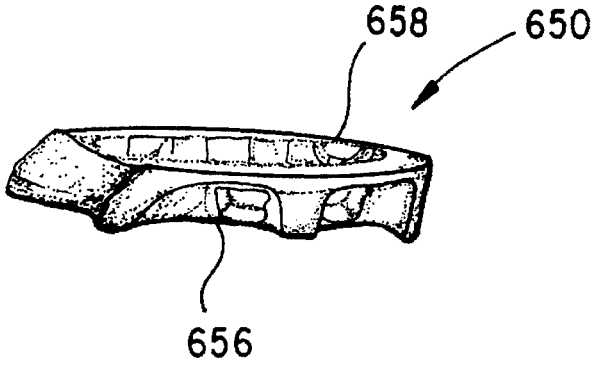
FIG. 63 is a side view of the sole element in accordance with the sixth embodiment of the invention and as shown in FIG. 57.
Figure 64:
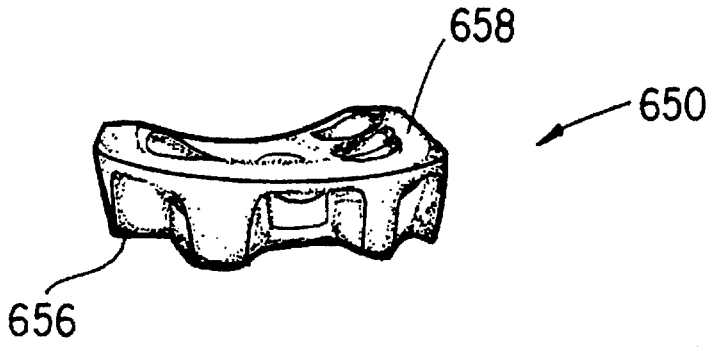
FIG. 64 is a rear-end view of the sole element in accordance with the sixth embodiment of the invention.
Figure 65:
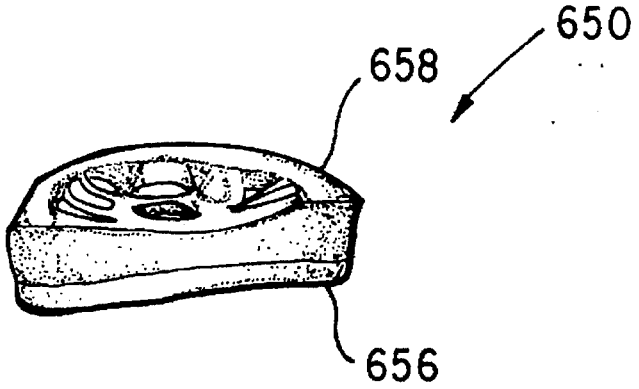
FIG. 65 is an end view of the sole element in accordance with the sixth embodiment of the invention.
Figure 66:
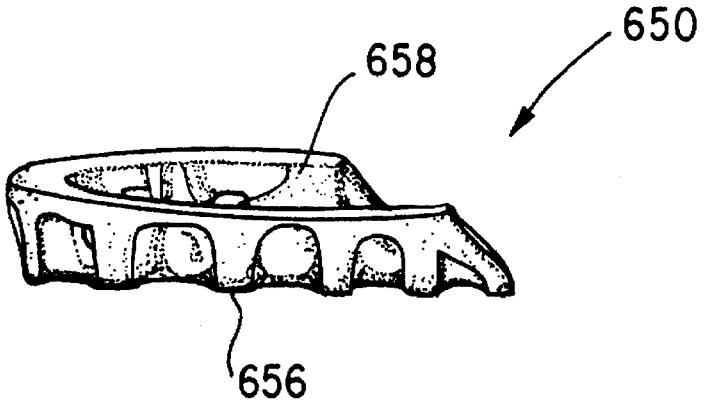
FIG. 66 is another side view of the sole element in accordance with the sixth embodiment of the invention.

FIGS. 57–60 show a footwear construction in accordance with the sixth embodiment of the invention. Shoe 602 may include upper 604, midsole 606, outsole 620 and support element 650. Support element 650 may be disposed in heel region 612 of midsole 606. Support element 650 may include cavities 630. Referring momentarily to FIG. 60, cavities 630 have open ends 631 along a periphery of heel region 612 and open ends 633 on bottom 619 of sole 605. As shown in FIG. 59, outsole 620 may have an opening 652 exposing part of support element 650 and cavities 630. The footwear construction in accordance with the sixth embodiment of the invention may incorporate any of the various features discussed above.

Referring now to FIGS. 61–66, support element 650 is discussed in greater detail. Support element 650 as shown may have cavities 630, an opening 654, a lower surface 658, which is disposed adjacent outsole 620, and an upper surface 656, which is disposed adjacent midsole 606. Cavities 630 may extend along lateral side 610, around the rear portion and along medial side 608 of heel region 612. As shown best in FIG. 62, cavities 630 may be smaller along medial side 608 and cavities 630 may be larger along the rear portion of heel region 612 moving toward and along lateral side 610. Cavities 630 are larger on lateral side 610 to provide greater stability, shock absorption and cushioning since generally lateral side 610 of heel region 612 impacts the ground first. Whereas, medial side 608 of heel region 612 may be made more rigid by making cavities 630 smaller. The purpose of this configuration is to provide more cushioning or shock absorption in a heel strike area (usually on lateral side 610). Additional cushioning or less cushioning is provided by positioning cavities 630 accordingly. In particular, larger cavities 630 provide more cushioning.

Figure 67:
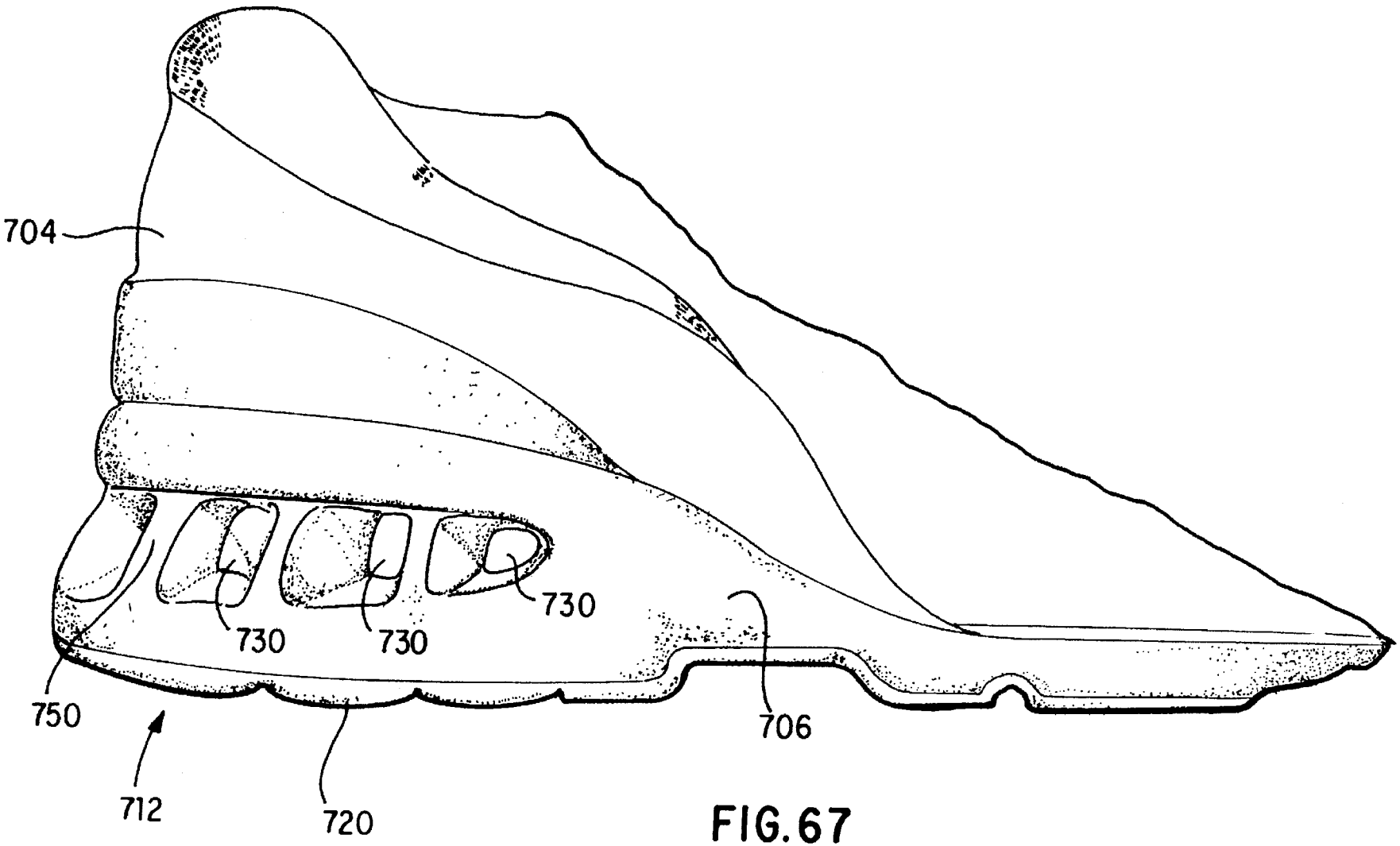
FIG. 67 is a side view of a footwear construction in accordance with a seventh embodiment of the invention.
Figure 68:
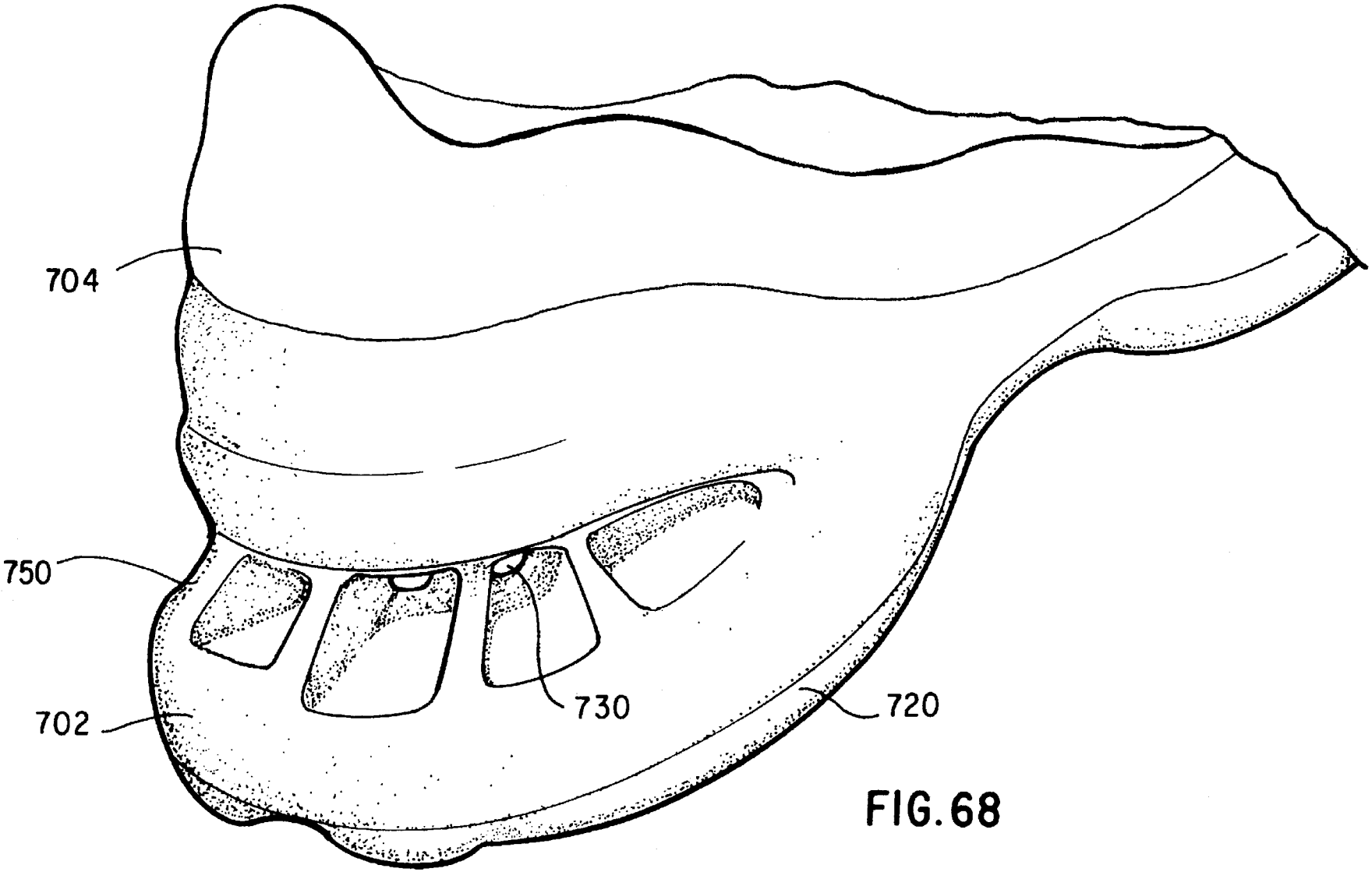
FIG. 68 is a portion of a perspective view in accordance with the seventh embodiment of the invention.
Figure 69:
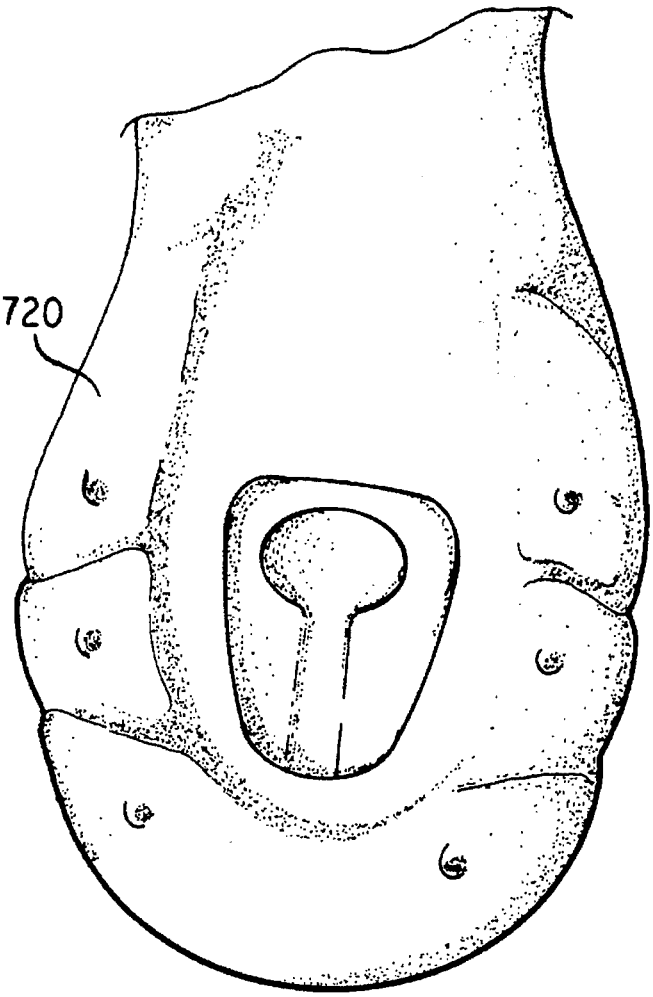
FIG. 69 is a bottom view in accordance with the seventh embodiment of the invention.
Figure 70:
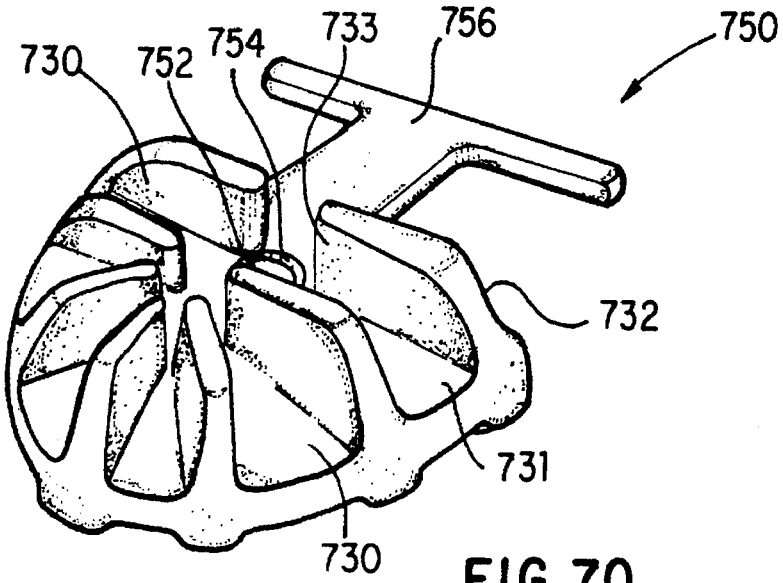
FIG. 70 is a perspective view of a sole element in accordance with the seventh embodiment of the invention.

Referring now to FIGS. 67–70, a footwear construction in accordance with the seventh embodiment of the invention is shown. FIGS. 67 and 68 show upper 704, midsole 706, and outsole 720. A support element 750, as shown in FIG. 70, may be disposed in heel region 712 of midsole 706. Support element 750 may include cavities 730 disposed along the periphery of heel region 712. Open ends 731 of cavities 730 may be disposed along the periphery of heel region 712. Open ends 733 may be disposed in the vicinity of an interior cavity 752. Support element 750 may include an opening 754 for exposing interior cavity 752 and an anchor 756 for anchoring support element 750 in midsole 706.

Figure 71:
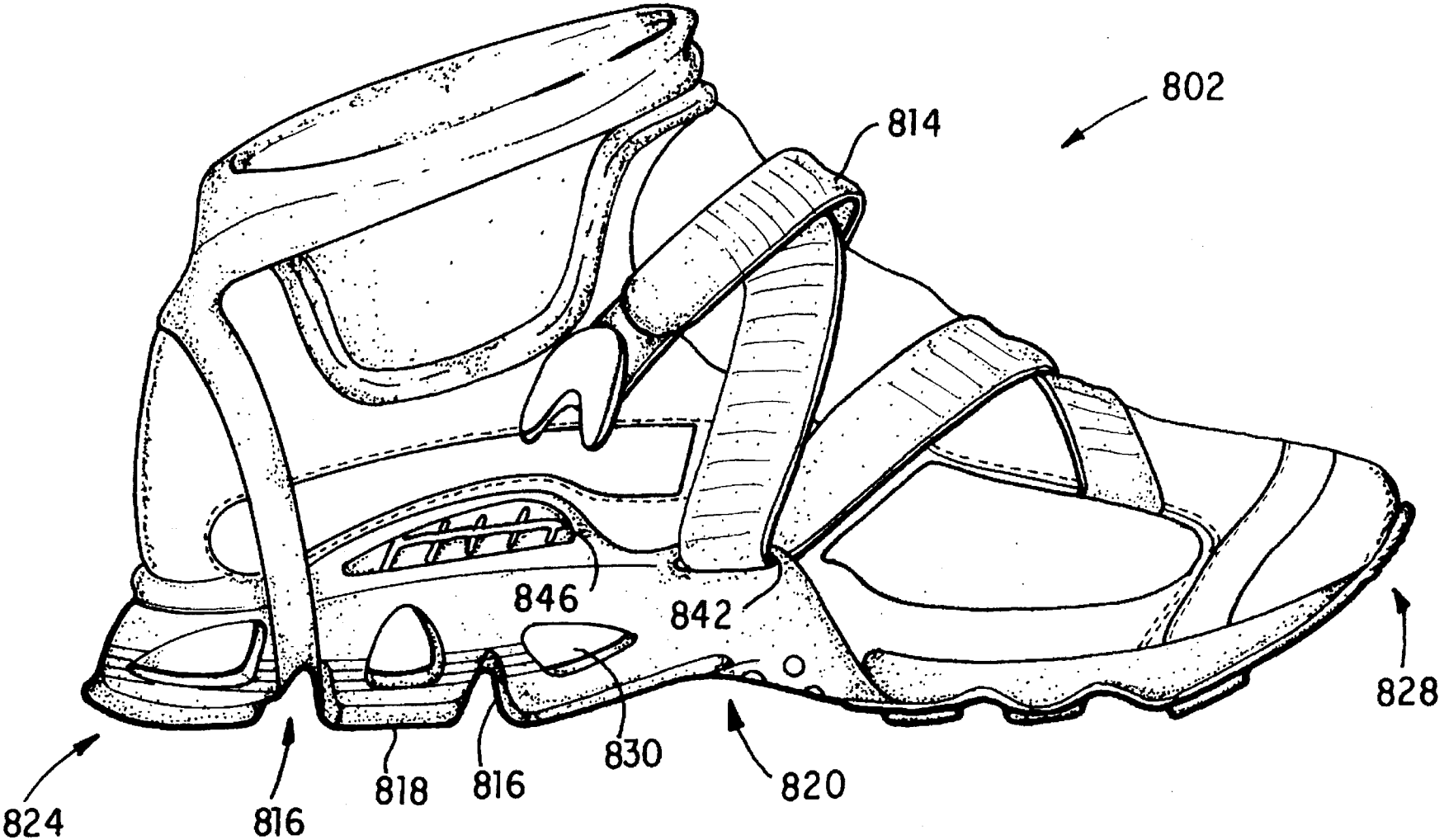
FIG. 71 is a perspective view of an embodiment of the invention having a support strap.
Figure 72:
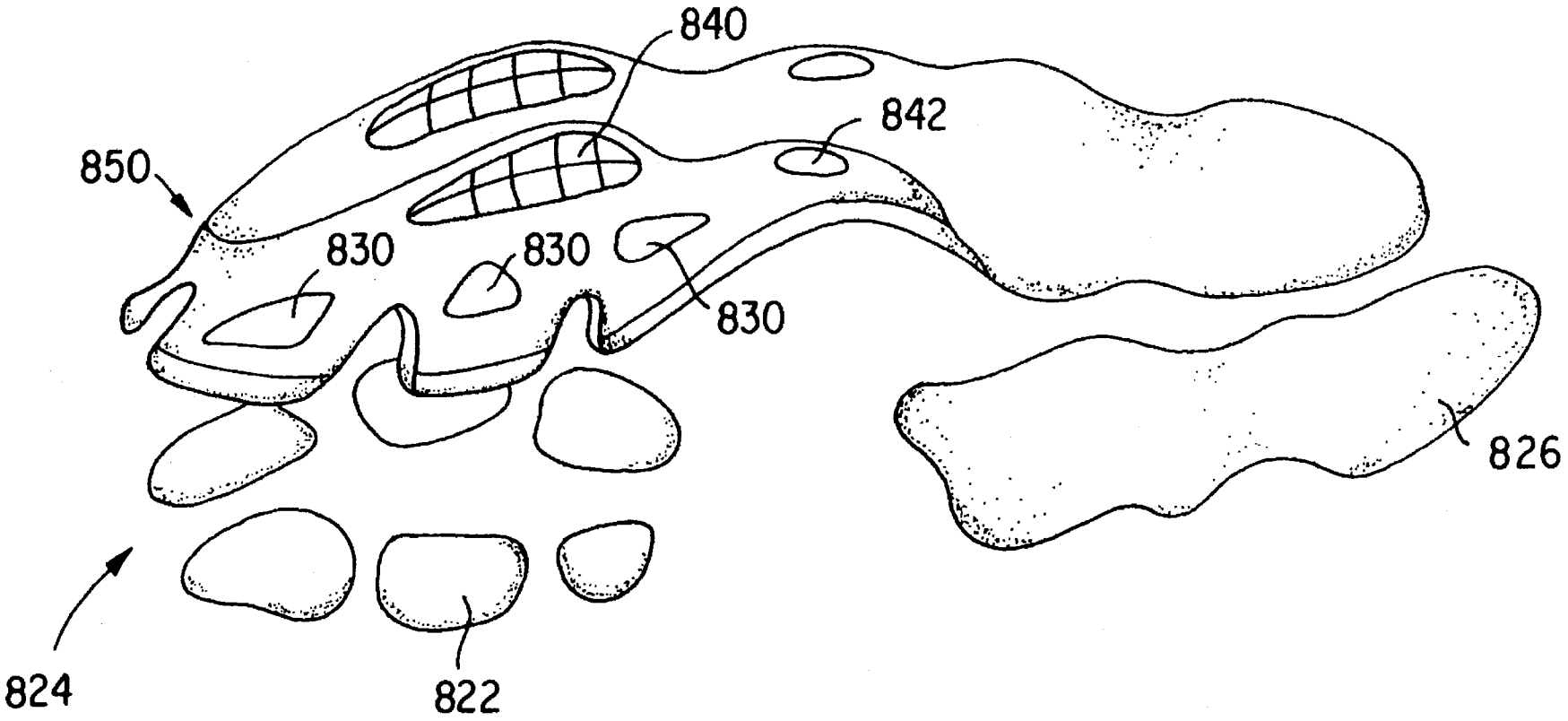
FIG. 72 is a perspective view of parts of the embodiment shown in FIG. 71.

FIG. 71 shows an embodiment of the invention incorporating strap 814 on shoe 802. As shown in the embodiment of FIG. 71, strap 814 is disposed in indentations 816 between lugs 818. However, straps 814 may pass through cavities 830. Strap 814 may serve, for example, as a restricting or tightening means, as decoration or may replace the function of shoe laces. Straps 814 may serve to control the rigidity, cushioning or shock absorption. Straps 814 may also provide support under arch 820. Straps 814 may be used to completely encircle the foot to provide support to the entire foot. In addition, strap 814 can extend in any direction or on any portion of shoe 802.

FIG. 71 shows a perspective view of part of shoe 802. Shoe 802 may include pads 822 in heel region 824 and a pad 826 in forefoot region 828. Pads 822 and 826 may comprise an outsole for shoe 802. Support element 850 may include cavities 830, vents 840, or strap openings 842 for strap 814 to pass through.

Figure 73:
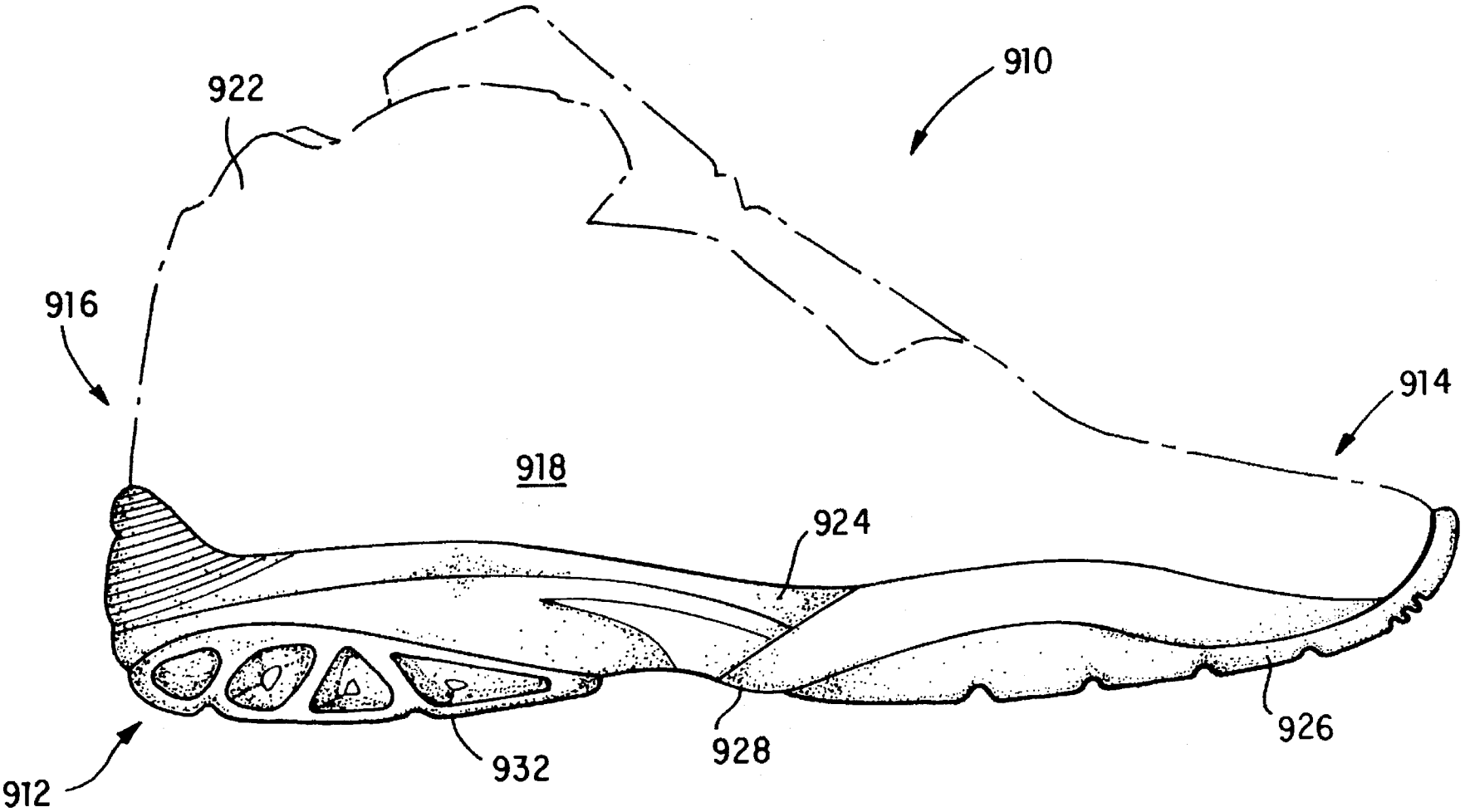
FIG. 73 shows a side view of a footwear construction according to another embodiment of the invention.

In another embodiment of the invention shown in FIGS. 73–80. FIG. 73 illustrates a medial side of a shoe 910 for use on a right foot of a wearer. As discussed above, the left foot shoe incorporating the invention should be a mirror image of shoe 901. Shoe 910 includes a forefoot region shown generally at 914, a heel region shown generally at 916 and a medial side 918. A lateral side of shoe 910 is shown generally at 920 in FIG. 23. Shoe 910 includes an upper 922 attached to a midsole 924. A lower surface 928 of midsole 924 is attached to an outsole 926 in forefoot region 914 of shoe 910. Outsole 926 is attached to midsole 924 by conventional means, such as, molding or adhesive. A sole element 912 is mounted on lower surface 928 of midsole 924 in heel region 916 of shoe 910. Sole element 912 is securely mounted on midsole 924 by any conventional techniques such as by adhesive, for example. A midsole attaching side of sole element 912 may have a slightly rough or unsmooth surface or may have any other conventional surface for attachment to midsole 924 or otherwise. Similar to the first embodiment, sole element 912 may be made of an outsole elastomeric material such as MILLATHANE.

Figure 74:
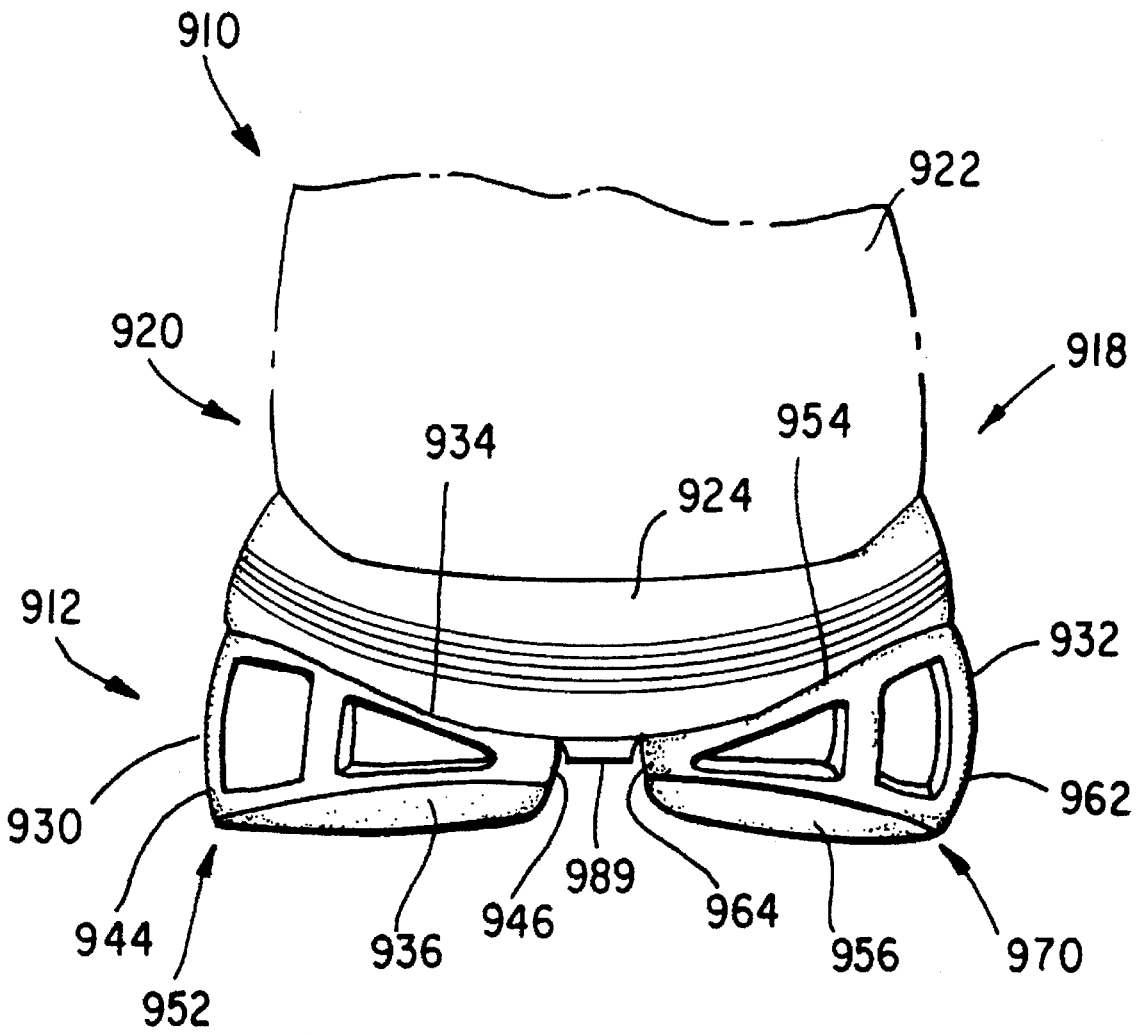
FIG. 74 is a rear view of the footwear construction in FIG. 73.
Figure 75:
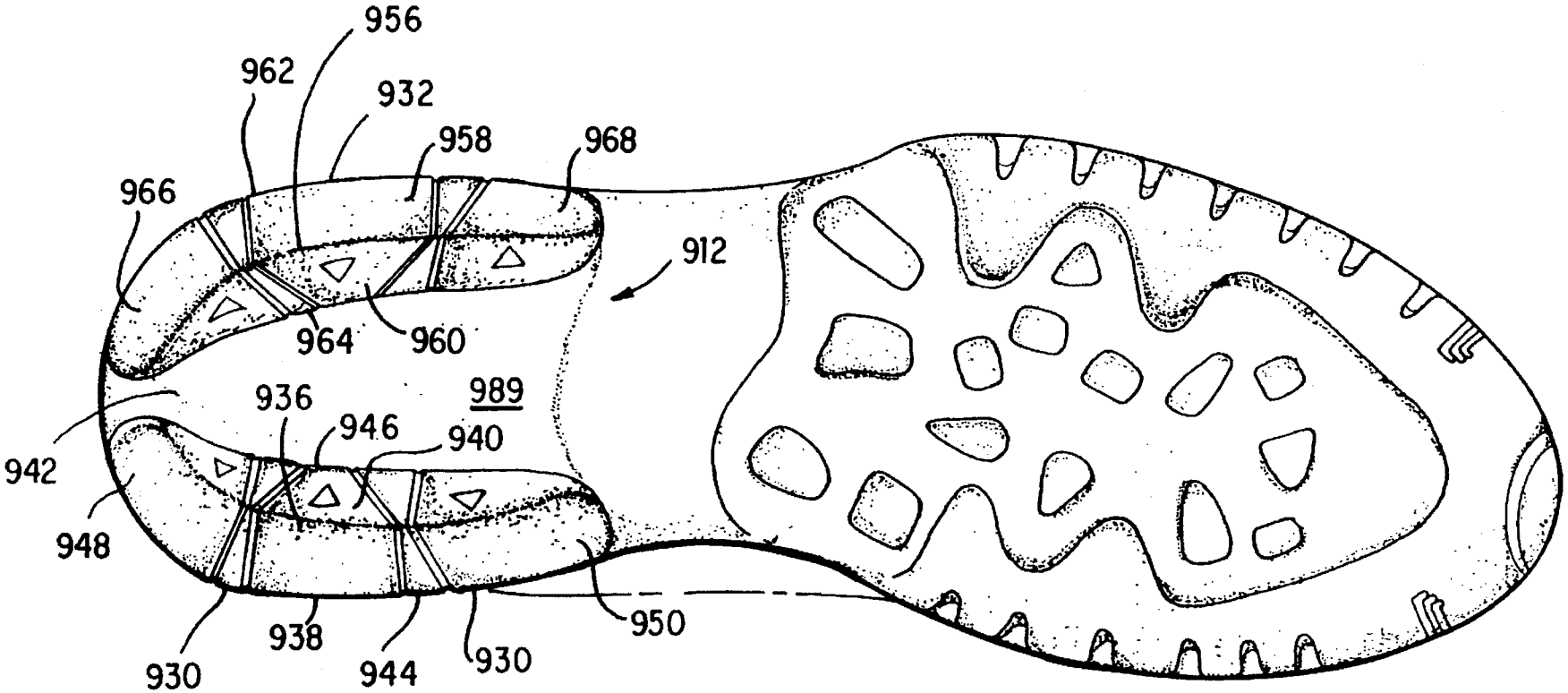
FIG. 75 is a bottom view of the footwear construction shown in FIG. 73.
Figure 76:
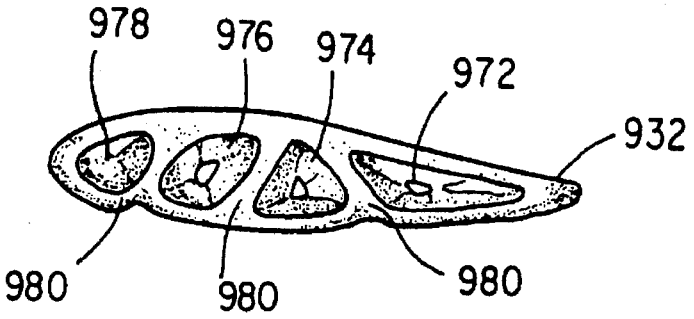
FIG. 76 is a side view of a support element of the footwear construction shown in FIG. 73.

Referring now to FIGS. 73–75, sole element 912 includes a first pod 930 disposed on lateral side 920 of midsole 924 and a second pod 932 disposed on medial side 918 of midsole 924. First pod 930 is connected to second pod 932 by a web 989 as will be discussed in greater detail in the following.

First pod 930 is substantially identical to second pod 932, however, is a mirror image of second pod 932. First pod 930 includes an upper surface 934 for being attached to lower surface 928 of midsole 924. A lower surface 936 of first pod 930 is for contacting a contact surface. The lower surface is substantially abrasive resistant because at least a portion of lower surface 936 contacts the contact surface. Lower surface 936 is made abrasive resistant by using the same material used for sole element 910 or by addition material to lower surface 936 of sole element 910 (not shown). As best shown in FIG. 75, lower surface 936 of first pod 930 includes a first portion 938 and a second portion 940. At least first portion 938 is abrasive resistant. Second portion 940 of lower surface 936 is disposed at an angle to first portion 938. Thereby, when sole element 912 is mounted on shoe 910, a concavity 942 is formed below the heel region 916 of shoe 910, as will be discussed in greater detail below.

First pod 930 is configured, generally, to have a first side 944 running along medial side 918 and between a heel end of heel region 916 and an instep region of shoe 910. Second side 946 of first pod 930 is disposed inwardly from first side 944 and extends between the heel end of heel region 916 and the instep region of shoe 910. First side 944 and second side 946 gradually taper towards each other as first pod 930 extends from the heel end of heel region 916 toward the instep region. A first end 948 of first pod 930 is disposed at the heel end of heel region 916 and a second end 950 of first pod 930 is disposed at the instep region of shoe 910. An edge 952 is defined by first side 944 and lower surface 936. Similar to first pod 930, second pod 932 includes an upper surface 954, a lower surface 956 including a first portion 958 and a second portion 960, a first side 962, a second side 964, a first end 966, a second end 968 and an edge 970. As illustrated, midsole 924 may extend further outwardly about an outer periphery of heel region 916 than first sides 944 and 962.

First and second pods 930 and 932 include cavities extending therethrough. Referring now to FIGS. 74 and 75, a medial side 918 of sole element 912 is shown thereby illustrating first side 962 of second pod 932. Second pod 932 includes cavities 972, 974 and 976, and a single recess 978. Cavities 972, 974 and 976 extend between first side 962 and second side 964, whereby each cavity 972, 974 and 976 has a first opening on first side 962 and a second opening on second portion 960 of lower surface 956. Cavities 972, 974 and 976 as shown by dash lines in FIG. 77 generally taper from first side 962 to second portion 960 of second pod 932. Accordingly, the first opening on first side 962 is larger than the second opening on second portion 960. In addition, cavities 972 and 974 have a substantially triangular transverse cross-section along the extension of cavities 972 and 974. In contrast, cavity 976 has a substantially hybrid transverse cross-section that changes along the extension of cavity 976. In particular, cavity 976 has a first transverse cross-section in the vicinity of the first opening on first side 962 that is the shape of a quadrilateral polygon. Whereas, a second transverse cross-section taken in the vicinity of the second opening on the second portion 944 is substantially triangular shaped. A gradual transition is made between the different cross-sections.

Recess 978 does not pass completely through second pod 932 and therefore only has a single opening on first side 944 of the second pod 932. In addition, as illustrated, struts are defined between cavities 972, 974 and 976, and recess 978 of second pod 932 and are similar to the struts discussed earlier in the specification.

The advantages of this particular embodiment having this particular combination of cavities 972, 974 and 976, and recess 978 are similar to the advantages discussed earlier, which include providing cushioning and stability to the foot of the wearer upon loading or heel strike and a return of usable energy upon shifting of loading from the heel to forefoot. This embodiment also facilitates tailoring first and second pods 930 and 932 to a particular user and use. Similar to second pod 932, first pod 930 also includes cavities 982, 984 and 986, and recess 988. Although this additional configuration of cavities and additional feature of using a recess is shown, it is within the scope of the invention to use other configurations and combinations, to achieve, for example, the ability to tailor sole element 912.

Figure 27:
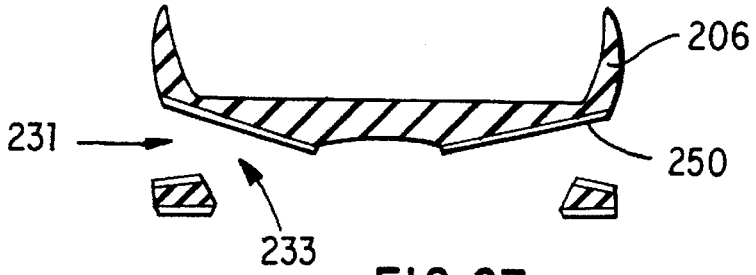
FIG. 27 is a cross-sectional view taken along line 27—27 shown in FIG. 23.
Figure 28:
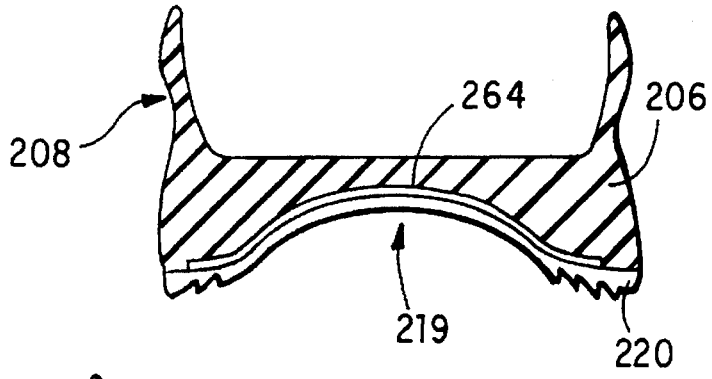
FIG. 28 is a cross-sectional view taken along line 28—28 shown in FIG. 23.
Figure 29:
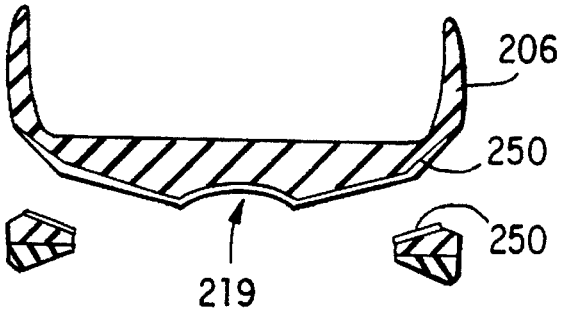
FIG. 29 is a cross-sectional view taken along line 29—29 shown in FIG. 23.

Web 989 extends between second sides 946 and 964 and adjacent upper surfaces 934 and 954 of first and second pods 930 and 932. As shown in FIG. 27, web 989 comprises a thin flexible sheet of material similar to the material of first and second pods 930 and 932. However, it is not necessary that the material of web 989 be the same as first and second pods 930 and 932. Accordingly, the upper surface of web 989 in combination with the upper surfaces 934 and 936 of first and second pods 930 and 932 comprise a mounting surface shown generally at 982. Web 989 serves to connect pods 930 and 932 such that sole element 912 may comprise a single unit, which is easy to manufacture in a single step, as well as, easy to mount on shoe 10. In particular, by extending web 989 between first and second pods 930 and 932, mounting surface 982 has a sufficient surface area to allow sole element 912 to be securely and reliably mounted on lower surface 928 of midsole 924.

Although web 989 is shown and described to be a continuous web extending across an entire area between pods 930 and 932, other embodiments, modifications and variations of web 989 are within the scope of the invention. In particular, the web may comprise a single strip extending between the first ends 948 and 966 of first and second pods 930 and 932. In the alternative, a plurality of strips may extend between first and second pods 930 and 932. These strips may comprise any width and further may be separated by any desirable distance therebetween. Furthermore, such strips need not be conventional strips and may comprise any configuration such as diagonal or curvilinear strips. In addition, an opening may pass through the web that comprises any shape, design or logo. Furthermore, the web need not comprise a sheet-like material and instead may have a substantial thickness that is constant or varies. As well, the web or a portion of the web may extend or project into midsole 924 to further anchor or secure sole element 912 with midsole 924 and shoe 910.

Figure 77:
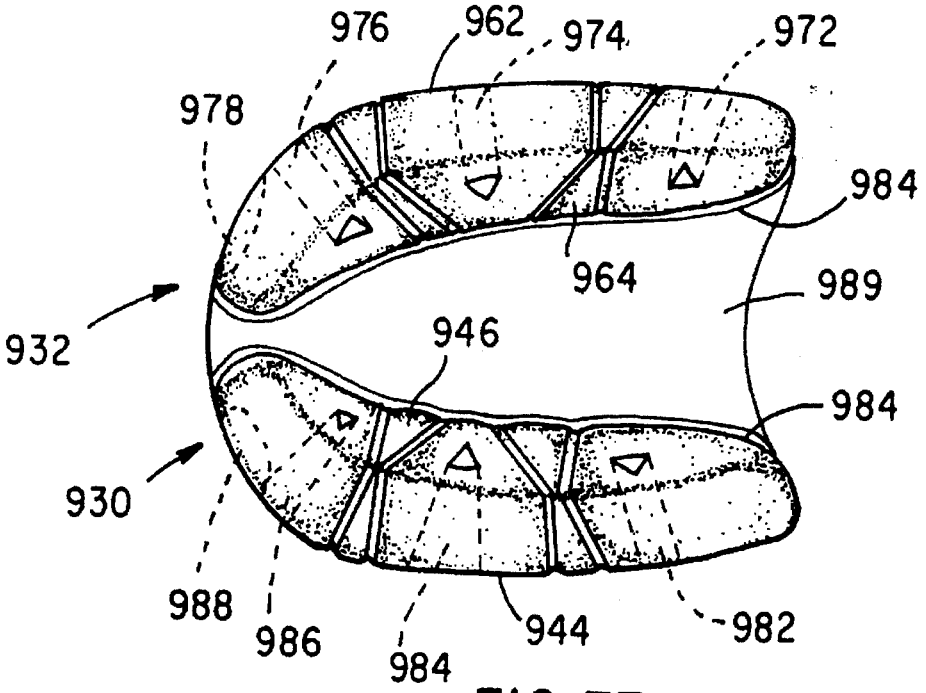
FIG. 77 is a bottom view of the support element shown in FIG. 76.
Figure 78:
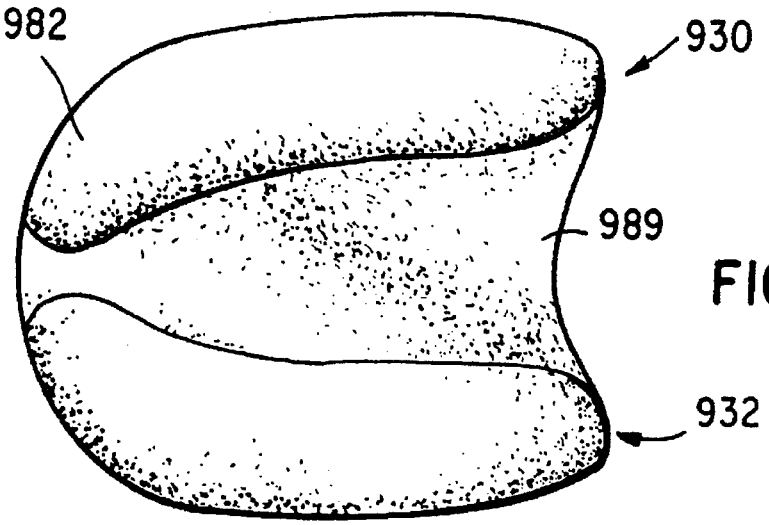
FIG. 78 is a top view of the support element shown in FIG. 76.

Referring to both FIGS. 77 and 78, grooves 984 are shown disposed along the joint connecting web 989 to first and second pods 930 and 932. Grooves 984 may be provided to serve as a color break such that pods 930 and 932 may be a different color than web 989.

Figure 79:
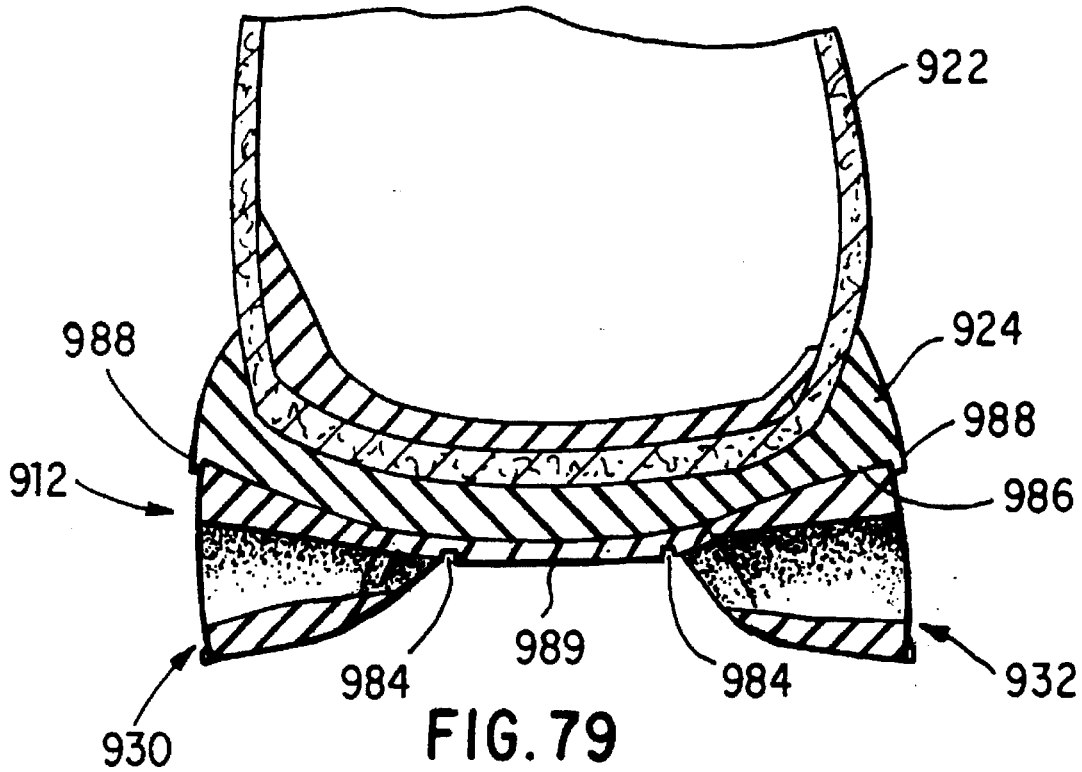
FIG. 79 is a cross-sectional view taken along line 79—79 shown in FIG. 73.
Figure 80:
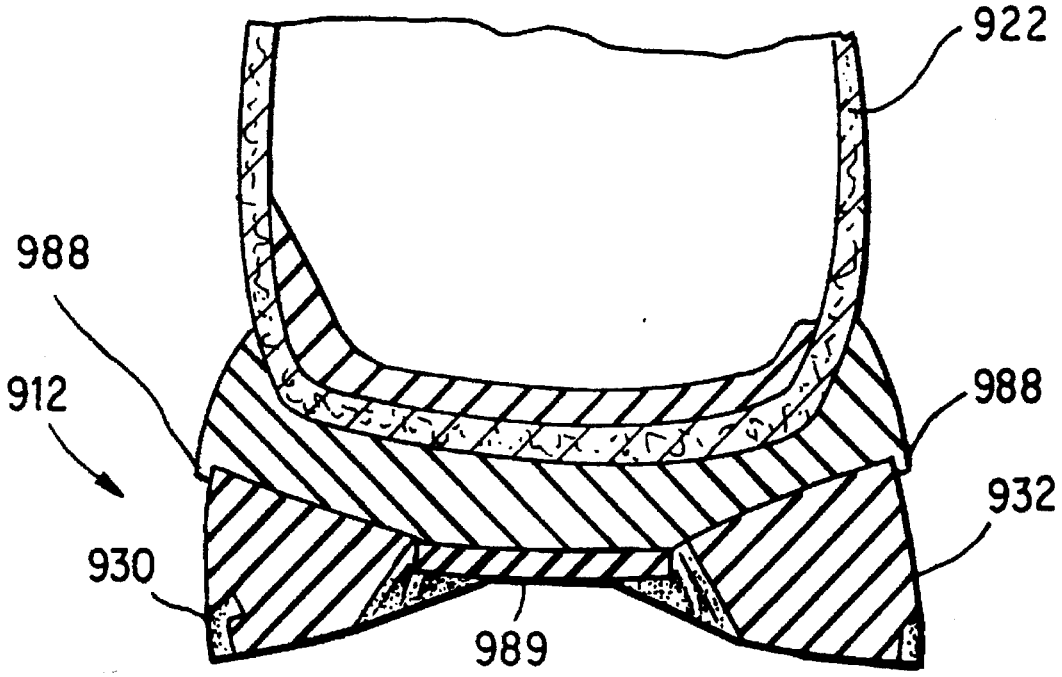
FIG. 80 is a cross-section view taken along line 80—80 shown in FIG. 73.

As shown in FIGS. 79 and 80, sole element 912 may be embedded in lower surface 928 of midsole 924. In particular, lower surface 928 of midsole 924 includes a recess 986 disposed therein and sized to receive sole element 912. Recess 986 is preferably a shallow recess having a midsole mounting surface corresponding substantially in shape to mounting surface 982 of sole element 912. Recess 986 may be preformed in lower surface 936 of midsole 924 or, in the alternative, recess 986 may be formed in midsole 924 by sole element 912. Recess 986 may include a flange 988 around an outer periphery of recess 986 to assist in positioning sole element 912 on midsole 924 during construction. However, flange 988 may be omitted in an alternate embodiment. Flange 988 may extend over a portion of sole element 912. In particular, flange 988 may cover the joint between mounting surface 982 of sole element 912 and the mounting surface in recess 986.

When sole element 912 is mounted on lower surface 928 of midsole 924, web 989 extends substantially horizontally between first and second pods 930 and 932. Upper surface 934 of first pod 930 is sloped at a first angle and upper surface 954 of second pod 932 is sloped at a second angle, which is opposed to the first angle. Lower surfaces 936 and 956 of first and second pods 930 and 932 each include two slopes. However, it is within the scope of the invention to have lower surfaces 936 and 956 comprise a single slope. In any event, lower surfaces 936 and 956 are shaped or sloped to define concavity 942 under sole element 912. In particular, the lower surfaces 936 and 956 of first and second pods 930 and 932, in combination with a lower surface of web 989 comprise a substantially concave surface. This feature aids in providing stability and shock absorption to the shoe.

Figure 81:
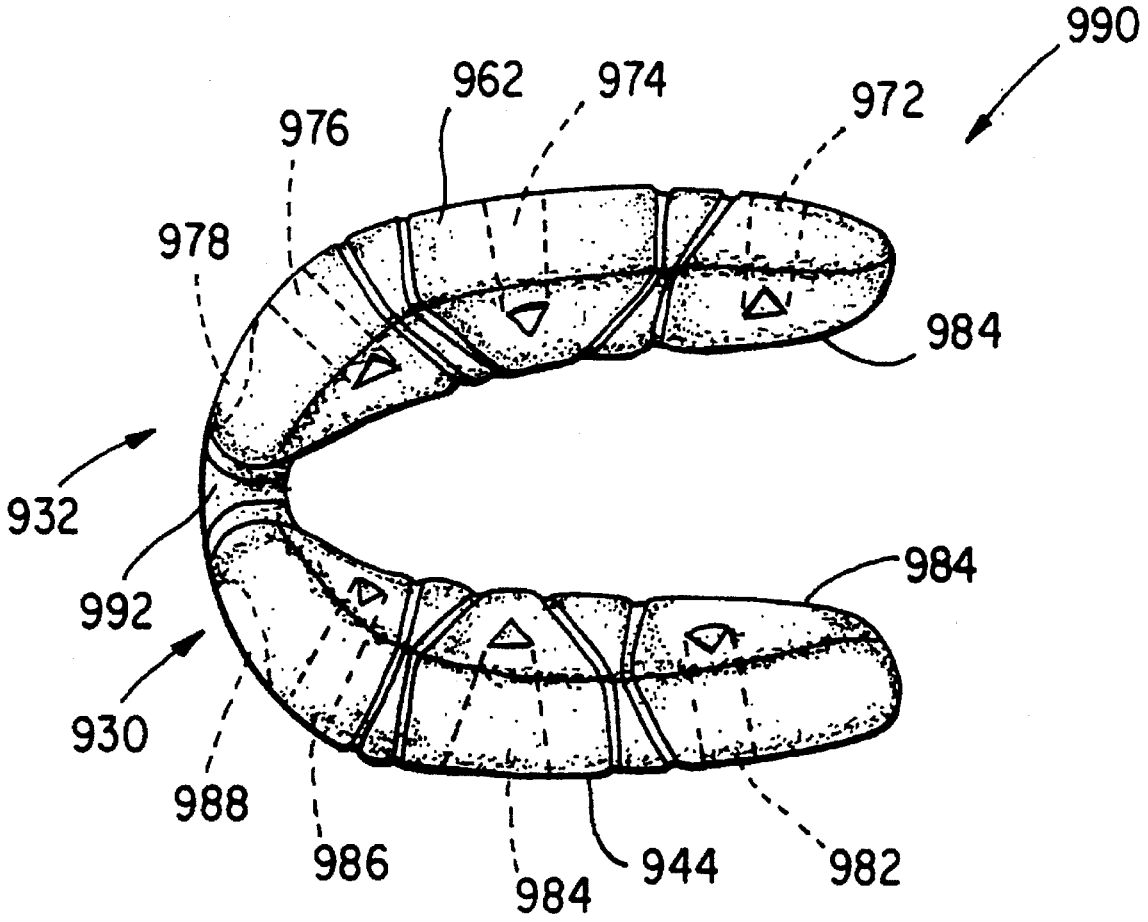
FIG. 81 is a bottom view of a support element of yet another embodiment of the invention.

FIG. 81 shows a modified embodiment of sole element 912 shown in FIGS. 73–80. Sole element 990 is similar to sole element 912, however, it has a modified web 992 extending between pods 930 and 932.

The shoe construction in accordance with the invention can embody a plurality of support structures having a cavity type shoe sole construction to provide shock absorption and stability. In addition, in accordance with the invention, the embodiments of support structures preferably incorporate a cantilever construction as disclosed in U.S. Pat. No. 4,372,058 to Stubblefield and which is incorporated herein by reference. In particular, the soles in accordance with the invention preferably result in a concave surface in the heel region. However, the construction in accordance with the invention when included in other types of soles has improved shock absorption and expansion of the sole upon contact with the ground due to the cavity construction in accordance with the invention.

While advantageous embodiments have been chosen to illustrate the invention, it will be understood by those skilled in the art that various changes and modifications can be made therein without departing from the scope of the invention as defined in the appended claims.

What is claimed is:

1. Footwear, comprising:

a midsole formed from a shock absorbing material, said midsole having a medial side and a lateral side;

a first pod disposed on said lateral side of said midsole, said first pod having a lower surface for contacting a contact surface, said lower surface being substantially abrasive resistant, wherein a first cavity extends through said first pod, and wherein said first cavity has an open first end and an open second end, and said open first end and said open second end of said first cavity are in tapered communication with one another extending transversely across the midsole;

a second pod disposed on said medial side of said midsole, said second pod having a lower surface for contacting a contact surface, said lower surface being substantially abrasive resistant, wherein a second cavity extends through said second pod, and wherein said second cavity has an open first end and an open second end, and said open first end and said open second end of said second cavity are in tapered communication with one another extending transversely across the midsole; and a web extending between said first and second pods disposed on said midsole and spaced apart from the contact surface, wherein said first pod and said second pod provide shock absorption upon contact with the contact surface.

2. Footwear according to claim 1, wherein said first pod has an upper surface for being disposed on said lateral side of said midsole and said second pod has an upper surface for being disposed on said medial side of said midsole and said web extends between said upper surface of said first pod and said upper surface of said second pod.

3. Footwear according to claim 1, wherein said midsole has a recess and said first pod, said second pod and said web are attached to said recess of said midsole.

4. Footwear according to claim 3, wherein said recess has a perimeter and a flange is defined by said recess around said perimeter, said flange extending a distance sufficient to cover a connection between said midsole and said first pod, second pod and web.

5. Footwear according to claim 1, wherein said first and second pods extend downwardly and outwardly relative to said midsole.

6. Footwear according to claim 1, wherein said first pod is formed from a material that is harder than the material of said second pod.

7. Footwear according to claim 1, wherein said first pod, said second pod and said web are monolithic.

8. Footwear according to claim 1, further comprising:

a first lug disposed on said lower surface of said first pod; and a second lug disposed on said lower surface of said second pod.

9. Footwear according to claim 1, further comprising:

a first recess disposed in a first side said first pod; and a second recess disposed in a first side of said second pod.

10. Footwear according to claim 1, wherein said midsole includes a heel region, and said first pod, said second pod and said web are disposed on said heel region of said midsole.

11. Footwear according to claim 1, wherein said midsole includes a forefoot region and further comprises a forefoot pad disposed on said forefoot region of said midsole.

12. Footwear according to claim 1, wherein said first pod and said second pod are made of a first material and said web is made of a second material.

13. Footwear according to claim 1, wherein a transverse cross section take through said at least one cavity in each of said first and second pods is triangular.

14. Footwear according to claim 1, wherein said first pod includes a plurality of cavities and said second pod includes a plurality of cavities.

15. Footwear according to claim 14, wherein one of said plurality of cavities in each of said first and second pods has a transverse cross section that is a quadrilateral polygon.

16. A sole element for a shoe, comprising:

a first pod for being disposed on a lateral side of the shoe, said first pod having a lower surface for contacting a contact surface, at least a portion of said lower surface being substantially abrasive resistant, wherein at least one first cavity extends through said first pod, and wherein said first cavity has an open first end and an open second end, and said open first end and said open second end of said first cavity are in tapered communication with one another extending transversely across the midsole;

a second pod for being disposed on a medial side of the shoe, said second pod having a lower surface for contacting a contact surface, at least a portion of said lower surface being substantially abrasive resistant, wherein at least one second cavity extends through said second pod, and wherein said second cavity has an open first end and an open second end, and said open first end and said open second end of said second cavity are in tapered communication with one another extending transversely across the midsole; and a web extending between said first and second pods and having an upper side for being disposed on said shoe, wherein said first pod, said second pod and said web are disposed on the shoe such that said first and second pods provide shock absorption and stability upon contact with the contact surface.

17. A sole element according to claim 16, wherein said web has a lower side opposing said upper side, and wherein said first pod lower surface, said web lower side and said second pod lower surface define a substantially concave surface and thereby a concavity under the shoe.

18. Footwear according to claim 16, wherein said first pod, said second pod and said web are monolithic.

* * * * *